US006954595B2

(12) United States Patent
Tsukida et al.

(10) Patent No.: US 6,954,595 B2
(45) Date of Patent: Oct. 11, 2005

(54) IMAGE FORMING APPARATUS FEATURING A DEVELOPER CARRYING MEMBER WITH A CONTROLLED OPERATION TIME AND RELATED CONTROL METHOD

(75) Inventors: Shinichi Tsukida, Saitama (JP); Katsuhiro Sakaizawa, Shizuoka (JP); Masahiro Shibata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 10/648,285

(22) Filed: Aug. 27, 2003

(65) Prior Publication Data

US 2004/0101322 A1 May 27, 2004

(30) Foreign Application Priority Data

Aug. 30, 2002 (JP) ..... 2002-256119
Aug. 30, 2002 (JP) ..... 2002-256130
Aug. 26, 2003 (JP) ..... 2003-302020

(51) Int. Cl.[7] ..... G03G 15/00; G03G 15/08
(52) U.S. Cl. ..... 399/12; 399/27; 399/44
(58) Field of Search ..... 399/10, 12, 27, 399/28, 44, 53, 54, 226–228

(56) References Cited

U.S. PATENT DOCUMENTS 5,194,895 A * 3/1993 Bares ..... 399/10
6,438,329 B1 * 8/2002 Budnik et al. ..... 399/12
6,564,024 B2 * 5/2003 Asano et al. ..... 399/53
6,600,889 B2 * 7/2003 Hiroki et al. ..... 399/228
6,647,233 B2 * 11/2003 Hiroki ..... 399/228
6,654,566 B1 * 11/2003 Yamaguchi et al. ..... 399/12
6,704,522 B2 * 3/2004 Sasago et al. ..... 399/12
2003/0133719 A1 7/2003 Tsuruya et al. ..... 399/12

FOREIGN PATENT DOCUMENTS

EP 1 059 573 A2 12/2000

* cited by examiner

*Primary Examiner*—William J. Royer
(74) *Attorney, Agent, or Firm*—Fitzpatrick, Cella, Harper & Scinto

(57) ABSTRACT

An image forming apparatus includes an image bearing member, a developing device, which includes a developer carrying member and a storage device, a contact/separation mechanism and control device. The control device operates the developer carrying member according to a state of the developing device.

27 Claims, 16 Drawing Sheets

STORAGE PORTION F

| |
|---|
| FINISH TIME OF IMAGE FORMATION |
| NUMBER OF PRINTED SHEETS |
| ⋮ |

STORAGE PORTION F

| |
|---|
| FINISH TIME OF IMAGE FORMATION |
| TONER REMAINING AMOUNT (CONSUMPTION AMOUNT) |
| NUMBER OF PRINTED SHEETS |
| ⋮ |

IMAGE FORMING APPARATUS FEATURING A DEVELOPER CARRYING MEMBER WITH A CONTROLLED OPERATION TIME AND RELATED CONTROL METHOD

BACKGROUND OF THE INVENTION

1. Field of the Invention

The present invention relates to an image forming apparatus that uses an electrophotographic process, an electrostatic recording process, or the like and has developing means which performs a development, operation with a contact development by a developer carrying member.

2. Related Background Art

Conventionally, in an image forming apparatus such as a copying machine, a printer, or a facsimile apparatus provided with a function for forming an image on a recording medium, an electrostatic latent image formed on an image bearing member such as a photosensitive drum is visualized as a developer image (toner image) with developing means using a developer (toner).

As such developing means, for example, a dry mono-component contact development has been proposed and put to practical use. In this system, an electrostatic latent image is often developed by bringing a rotating image bearing member (photosensitive drum) and a developer carrying member such as a developing roller bearing a developer, which is also rotating, into pressed contact or contact with each other with an appropriate relative peripheral speed difference. In addition, in this system, there are many advantages such as a magnetic material is unnecessary, an apparatus can be easily simplified and miniaturized, and the developing means employing the system can be applied to a full color image forming apparatus because a mono-component developer containing a nonmagnetic toner is used.

In recent years, in the midst of diversification of demands, a request for colorization of an image to be outputted by a printer used, for example, in an office or the like has been increasing.

In an attempt to respond to such a request, color image forming apparatuses according to several techniques have been proposed. As an example, a color image forming apparatus of an intermediate transfer member system has been proposed. The color image forming apparatus aims to obtain a color image without color drift by providing, other than a first image bearing member such as a photosensitive drum on which surface a toner image is formed, an intermediate transfer member serving as a second image bearing member to which plural colors of toner images being superimposed on one another are to be primarily transferred from the first image bearing member, and secondarily transferring a complex toner image of the plural colors formed on the intermediate transfer member collectively to a transfer material.

FIG. 12 shows a schematic diagram thereof. In the figure, first, a photosensitive drum 101, which is driven to rotate in a direction of an arrow at a predetermined process speed, is uniformly charged by a charging roller 102 on its surface. Next, the photosensitive drum 101 is subjected to scanning exposure by a laser beam 103 which is ON/OFF controlled according to image information, thus forming an electrostatic latent image on the photosensitive drum 101.

This electrostatic latent image is developed by developing means containing a developer. In this example, the electrostatic latent image is developed and visualized by a rotary developing apparatus 104 which is capable of switching each developing means through rotation.

In this rotary developing apparatus 104, the four developing means each have a developing roller 111 serving as a developer carrying member. The rotary developing apparatus 104 is constituted by integrally forming the four developing means, namely, a first developing device 104*a* containing a yellow toner as a developer (toner) of a first color, a second developing device 104*b* containing a magenta toner as a developer (toner) of a second color, a third developing device 104*c* containing a cyan toner as a developer (toner) of a third color, and a fourth developing device 104*d* containing a black toner as a developer (toner) of a fourth color. First, the electrostatic latent image is developed and visualized by the first developing device 104*a* containing the yellow toner as the toner of the first color. Note that, these toners are mono-component nonmagnetic toner, and a normal polarity thereof is negative.

A visualized first toner image is electrostatically transferred (primarily transferred) onto a surface of an intermediate transfer belt 105, which serves as an intermediate transfer member to be driven to rotate in the direction of the arrow, in a first transfer region 106 which is opposed to the intermediate transfer belt 105. Note that primary transfer remaining toner, a slight amount of which remains on the surface of the photosensitive drum 101 having finished primary transfer, is removed by a cleaning device 107. This cleaning device 107 has a cleaning blade 107*a* including an elastic member which abuts against the surface of the photosensitive drum 101 in a so-called counter direction.

Subsequently, toner images are sequentially superimposed and transferred onto the intermediate transfer belt 105 by repeating the above-mentioned process three times using the second to fourth developing devices 104*b* to 104*d*. That is, a second toner image developed with the magenta toner, a third toner image developed with the cyan toner, and a fourth toner image developed with the black toner are sequentially transferred to and stacked on the surface of the intermediate transfer belt 105.

Thereafter, a secondary transfer roller 108, which has been in a separated state with respect to the surface of the intermediate transfer belt 105, is brought into pressed contact with the surface of the intermediate transfer belt 105 and is driven to rotate. The toner images formed on the surface of the intermediate transfer belt 105 are collectively transferred (secondarily transferred) onto a surface of a transfer material P which is conveyed at predetermined timing to a second transfer region 109. This transfer material P is conveyed to a fixing device 110 to have the toner images fixed as a permanent image, and then discharged to the outside of the apparatus.

Here, the respective developing devices 104*a*, 104*b*, 104*c*, and 104*d* are in the form of a cartridge and have: the developing roller 111 serving as the developer carrying member; a developing blade 112 serving as a developer regulating member which abuts against the developing roller 111 to regulate an amount of toner on the developing roller 111; a supply roller 113 which abuts against the developing roller 111 to supply a mono-component nonmagnetic toner to the developing roller 111; and an agitating member 114 which carries a toner to the vicinity of the supply roller 113. The developing devices 104*a*, 104*b*, 104*c*, and 104*d* are detachably attachable to the developing apparatus 104 in the image forming apparatus.

Note that the developing roller 111 rotates while abutting against the photosensitive drum 101 to thereby perform a development operation of carrying a toner contained in the developing means and feeding the toner to an electrostatic latent image portion on the surface of the photosensitive drum 101. Therefore, the developing roller 111 preferably has at least an elastic body in order to be compatible with a so-called contact development. Then, a predetermined DC bias is supplied to the developing roller 111 from a development bias power supply (not shown) in order to transfer the toner from the developing roller 111 to the surface of the photosensitive drum 101.

As the developer carrying member, a developing roller having elasticity and electrical conductivity is often used. That is, since development is performed by bringing the developing roller into pressed contact or contact with an image bearing member, in particular, in the case in which the image bearing member is a rigid body, the developing roller is constituted by an elastic body in order to prevent damage to the image bearing member.

In addition, the developing blade 112 is brought into abutment against the surface of the developing roller 111 with a light pressure utilizing spring elasticity of a thin metal plate.

However, in such an image forming apparatus using a mono-component nonmagnetic toner, deficiencies as described below may occur.

In order to obtain a satisfactory image quality, a toner charging amount is required to be appropriately large. This amount depends upon a charging amount the toner itself and a charging amount which is obtained by triboelectrification due to rubbing in an abutment nip portion between a developing roller and a developing blade to which the toner is carried in accordance with the rotation of the developing roller.

Then, for example, in the case in which image formation is performed after the toner is left as it is for a long time, the charging amount of the toner itself in the developing means is decayed. In a very early stage immediately after starting up the apparatus, in particular, in the case in which a mono-component nonmagnetic toner not using a carrier is used, image formation is started in a state in which a sufficient charge is not given to the toner and a sufficient charging amount is not obtained, or the charging amount cannot be maintained uniformly. Thus, an image failure such as a low image density or a non-uniform image density may occur.

In particular, in a so-called contact development which is adopted in the image forming apparatus of FIG. 12, fluctuation in charging of a toner, which occurs on the developing roller 111, easily becomes evident as unevenness of an image.

In addition, this phenomenon tends to occur conspicuously in a situation in which it is hard to obtain a sufficient toner charging amount, for example, in the case in which an amount of toner remaining in the developing means is large, or in a situation in which the image forming apparatus is installed in an environment of high temperature and high humidity.

Further, in such an image forming apparatus using a mono-component nonmagnetic toner, in the case in which developing means being in an unused state is used for the first time to perform image formation, deficiencies as described below may occur.

In general, the developing means in an unused state is provided with a seal member between a toner container portion, in which a toner is contained, and a development portion in which members such as a developing roller and a developing blade are disposed. The developing means is brought into a usable state upon removal of this seal member by a user. However, in an early stage of use, it is hard to coat the toner on the surface of the developing roller uniformly and, if image formation is performed in this state, image failure such as a non-uniform image density may occur.

In addition, in order to obtain a satisfactory image quality, a toner charging amount is required to be appropriately large. This amount depends upon a charging amount of the toner itself and a charging amount which is obtained by triboelectrification due to rubbing in an abutment nip portion between a developing roller and a developing blade to which the toner is carried in accordance with the rotation of the developing roller.

However, in the case in which image formation is performed using developing means in an unused state, the charging amount of the toner itself in the developing means is decayed. In a very early stage immediately after starting to use the developing means, image formation is started in a state in which a sufficient charge is not given to the toner and a sufficient charging amount is not obtained, or the charging amount cannot be maintained uniformly. Thus, an image failure such as a low image density or a non-uniform image density may occur. In particular, in a so-called contact development which is adopted in the image forming apparatus of FIG. 12, fluctuation in charging of a toner on the developing roller 111 easily becomes evident as unevenness of an image.

This phenomenon occurs very easily in developing means which has a less toner carrying force caused by a magnetic force compared with a development using a developing sleeve, which includes a magnet in its inside, and a magnetic toner. In particular, the phenomenon is more conspicuous in a mono-component nonmagnetic development using a mono-component nonmagnetic toner which has a substantially spherical shape.

In addition, this phenomenon tends to occur more conspicuously in a situation in which it is hard to obtain a sufficient toner charging amount, for example, in a situation in which the image forming apparatus is installed in an environment of high temperature and high humidity.

SUMMARY OF THE INVENTION

Therefore, it is an object of the present invention to provide an image forming apparatus capable of preventing occurrence of image failure due to insufficiency in a toner charging amount and forms a high quality image, and to provide a control method for the image forming apparatus.

In addition, it is another object of the present invention to provide an image forming apparatus in which a toner is sufficiently charged in developing means, thereby being capable of preventing image failure due to insufficiency in a toner charging amount, and of forming a high quality image even in image formation after the toner is left as it is for a long time, and to provide a control method for the image forming apparatus.

Further, it is another object of the present invention to provide an image forming apparatus, in which a toner is sufficiently charged in developing means, thereby being capable of preventing image failure due to insufficiency in a toner charging amount, and of forming a high quality image even in image formation using developing means in an unused state, and to provide a control method for the image forming apparatus.

An image forming apparatus according to the present invention includes:

an image bearing member on a surface of which an electrostatic latent image is formed;

developing means which has a rotatable developer carrying member, which contains a developer and abuts against the surface of the image bearing member, and storage means storing information on image formation history, and visualizes the electrostatic latent image on the surface of the image bearing member as the developer carrying member carries the developer to the electrostatic latent image;

a moving mechanism which moves the developing means to one of a first position where development is performed and a second position where development is not performed; and control means which controls, based upon the information on image formation history stored in the storage means, an operation for giving a charge to the developer according to a lapsed time from a finish time of image formation, in a state in which the developing means is moved to the second position by the moving mechanism.

Another image forming apparatus according to the present invention includes:

an image bearing member on a surface of which an electrostatic latent image is formed;

developing means which has a rotatable developer carrying member, which contains a developer and abuts against the surface of the image bearing member, and storage means storing information on image formation history, and visualizes the electrostatic latent image on the surface of the image bearing member as the developer carrying member carries the developer to the electrostatic latent image;

a moving mechanism which moves the developing means to a first position where development is performed and a second position where development is not performed; and control means which judges, based upon existence of the information on image formation history stored in the storage means, whether or not the developing means is in an unused state, and in the case in which the developing means is recognized as being in the unused state, controls an operation for giving a charge to the developer in a state in which the developing means is moved to the second position.

A control method for an image forming apparatus according to the present invention is a control method for an image forming apparatus including: an image bearing member; developing means which has a rotatable developer carrying member, which contains a developer and abuts against the image bearing member, and storage means storing information on image formation history, and forms an image on the image bearing member as the developer carrying member carries the developer to the image bearing member; a moving mechanism which moves the developing means to one of a first position where development is performed and a second position where development is not performed; and reading/writing means which accesses the storage means. The control method includes:

reading the information on image formation history stored in the storage means with the reading/writing means before image formation of second and subsequent times using the developing means;

finding a lapsed time from a finish time of image formation of the last time based upon the information on image formation history; and controlling, in accordance with the lapsed time, an operation for giving a charge to the developer in a state in which the developing means is moved to the second position by the moving mechanism.

Another control method for an image forming apparatus according to the present invention is a control method for an image forming apparatus including: an image bearing member; developing means which has a rotatable developer carrying member, which contains a developer and abuts against the image bearing member, and storage means storing information on image formation history, and forms an image on the image bearing member as the developer carrying member carries the developer to the image bearing member; a moving mechanism which moves the developing means to one of a first position where development is performed and a second position where development is not performed; and reading/writing means which accesses the storage means. The control method includes:

reading the information on image formation history of the storage means with the reading/writing means;

judging whether or not the developing means is in an unused state according to existence of the information on image formation history; and controlling, in the case in which judgment is made that the developing means is in the unused state, an operation for giving a charge to the developer in a state in which the developing means is moved to the second position.

Further objects of the present invention will be apparent by reading the following detailed description of the invention with reference to the accompanying drawings.

DETAILED DESCRIPTION OF THE PREFERRED EMBODIMENTS

An image forming apparatus and a control method for the image forming apparatus will be hereinafter described more in detail with reference to the accompanying drawings.

Note that structures described in the following embodiments are simply examples and do not limit the scope of the present invention to them only.

First Embodiment

Figure 1:
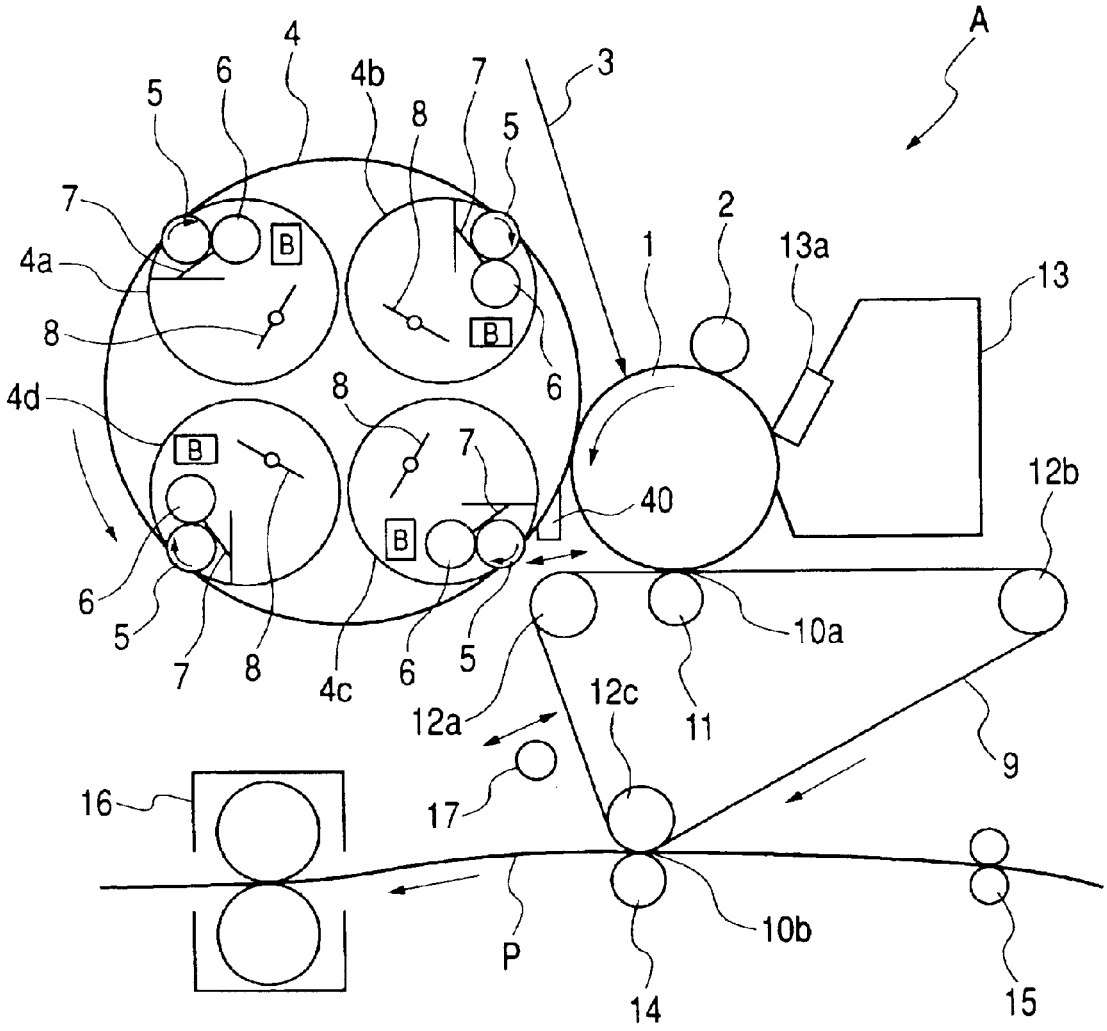
FIG. 1 is a schematic diagram showing an example of an image forming apparatus in accordance with the present invention.

A schematic diagram of FIG. 1 shows a color image forming apparatus A which is an example of the image forming apparatus in accordance with the present invention. In FIG. 1, a photosensitive drum with a photosensitive material such as OPC (organic photoconductor) formed on an external peripheral surface of a cylinder-like base body made of aluminum is used as a photosensitive drum 1 serving as a first image bearing member. An outer diameter thereof is 50 mm. The photosensitive drum 1 is driven to rotate in a direction of arrow at a peripheral speed of 120 mm/sec.

In this specification, image formation performed by the image forming apparatus is an operation for forming an electrostatic latent image on the photosensitive drum 1 based on external information, developing and visualizing the electrostatic latent image to form a developer image (toner image), and recording the developer image on a transfer material P such as paper. A process in which the image formation is performed is referred to as an image forming process.

The image forming operation in the image forming process will be described in detail. First, a surface of the photosensitive drum 1 is uniformly charged to approximately −700 V as a dark section potential VD by a charging roller 2 serving as a charging device. A vibration voltage in which an AC voltage is superimposed on a DC voltage is applied to this charging roller 2.

Next, the surface of the photosensitive drum 1 is subjected to scanning exposure by a laser beam 3, which is ON/OFF controlled according to first image information, and a first electrostatic latent image of approximately −150 V as a bright section potential VL is formed thereon.

The electrostatic latent image formed in this way is developed and visualized by a rotary developing apparatus 4. The developing apparatus 4 is mounted with, as developing means, a first developing device 4*a* containing a yellow toner as a developer (toner) of a first color, a second developing device 4*b* containing a magenta toner as a toner of a second color, a third developing device 4*c* containing a cyan toner as a toner of a third color, and a fourth developing device 4*d* containing a black toner as a toner of a fourth color. The respective developing devices 4*a*, 4*b*, 4*c*, and 4*d* can be switched sequentially by rotating to move them to a development position opposed to the photosensitive drum 1 with a predetermined switching time.

The developing means serving as the respective developing devices 4*a* to 4*d* include a developing roller 5 serving as a developer carrying member for moving the toner of each color in the developing device to the surface of the photosensitive drum 1, a rotatable supply roller 6 for supplying the toner to the developing roller 5, a developing blade 7 serving as a developer regulating member for regulating an amount of toner to be born on a surface of the developing roller 5, and a rotatable agitating member 8 for carrying the toner to the vicinity of the supply roller 6. Moreover, the developing means have a memory portion B serving as storage means such as a flash memory which is capable of recording and referring to an image formation history to be described in detail later.

The respective developing devices 4*a* to 4*d* mounted on the rotary developing apparatus 4 are sequentially moved to the development position opposed to the photosensitive drum 1 according to the rotation of the rotary developing apparatus 4. The developing device opposed to the photosensitive drum 1, which is assumed to be the developing device 4*a* here, is pressurized to move in a direction of the photosensitive drum 1 by a contact/separation mechanism 40 having a clutch or the like as the developing roller 5 is driven to rotate in the direction of arrow by a motor (not shown). The developing roller 5 provided in the developing device 4*a* rotates to abut against the surface of the photosensitive drum 1. A rotation peripheral speed of the developing roller 5 is generally equal to or higher than a rotation peripheral speed of the photosensitive drum 1.

A predetermined DC bias is applied to the developing roller 5 by a high voltage power supply (not shown). The toner on the developing roller 5 is transferred to an exposed portion, that is, an electrostatic latent image portion, on the photosensitive drum 1 by a potential difference between an exposed portion potential on the photosensitive drum and the DC bias, whereby the electrostatic latent image may be visualized and developed.

In this way, a contact development is adopted in which the developing roller 5 is brought into pressed contact or contact with the surface of the photosensitive drum 1 by the contact/separation mechanism 40, it is preferable to use a developing roller with a form having an elastic layer of rubber or the like on an external peripheral surface of a metal core.

The developing blade 7 is constituted by a thin metal plate and is brought into abutment against the surface of the developing roller 5 with a light pressure utilizing spring elasticity of the thin metal plate. As the developing roller 5 rotates, the developing blade 7 rubs and frictionally charges a toner, which is carried to an abutment nip portion between the developing roller 5 and the developing blade 7 to thereby give a charge to the toner and, at the same time, regulate a thickness of a layer of the toner.

As a material for the thin metal plate, stainless steel, phosphor bronze, or the like can be used. In this embodiment, a phosphor bronze thin metal plate with a thickness of 0.1 mm was used.

Note that a normal charging polarity of the yellow toner, the magenta toner, the cyan toner, and the black toner is negative. Then, first, the first electrostatic latent image is developed and visualized by the first developing device 4*a* containing the yellow toner as the toner of the first color.

A voltage of a polarity opposite to the normal charging polarity of the toner (primary transfer bias) is applied to a primary transfer roller 11 by a high voltage power supply (not shown) in a first transfer portion 10*a* opposed to an intermediate transfer belt 9 serving an intermediate transfer body to be driven to rotate in a direction of arrow, whereby a yellow toner image on the visualized photosensitive drum 1 may be electrostatically transferred (primarily transferred) onto the surface of the intermediate transfer belt 9.

The intermediate transfer belt 9 is supported by suspend rollers 12*a*, 12*b*, and 12*c* and is driven to rotate in the direction of arrow at a peripheral speed substantially equal to the peripheral speed of the photosensitive drum 1 while being brought into pressed contact with the photosensitive drum 1 with a predetermined pressing force by the primary transfer roller 11.

Note that a slight amount of a primary transfer remaining toner on the surface of the photosensitive drum 1 which has finished primary transfer is removed by a cleaning device 13. This cleaning device 13 is equipped with a cleaning blade 13*a*, which has an elastic member formed of urethane rubber or the like, at a tip of a support member formed of sheet metal or the like. The cleaning device 13 brings a tip of the elastic member into abutment against the surface of the photosensitive drum 1 with a predetermined pressing force from a so-called counter direction to thereby remove the primary transfer remaining toner from the surface of the photosensitive drum 1.

Moreover, the above-mentioned process is repeated three times using the developing devices 4*b* to 4*d*. Each time the process is repeated, a magenta toner image developed by the magenta toner, a cyan toner image developed by the cyan toner, and a black toner image developed by the black toner are sequentially transferred to and stacked on the surface of the intermediate transfer belt 9.

Thereafter, a secondary transfer roller 14, which is in a separated state with respect to the surface of the intermediate transfer belt 9, is brought into pressed contact with the suspend roller 12*c* via the intermediate transfer belt 9 with a predetermined pressing force to be driven to rotate.

A voltage of a polarity opposite to the normal charging polarity of the toner (secondary transfer bias) is applied to the secondary transfer roller 14 by the high voltage power supply (not shown), whereby the toner images stacked and formed on the surface of the intermediate transfer belt 9 may be collectively transferred (secondarily transferred) onto the surface of the transfer material P which is conveyed to a second transfer portion 10*b* at predetermined timing by registration rollers 15. This transfer material P is conveyed to a fixing device 16 and, after the toner images are fixed as the permanent image, discharged to the outside of the apparatus.

Note that a slight amount of a secondary transfer remaining toner on the surface of the intermediate transfer belt 9 which has finished secondary transfer is removed by a cleaning device 17 which abuts against the surface of the intermediate transfer belt 9 at predetermined timing.

The above-mentioned process is an image forming process on one transfer material P, and is for image formation for one time. However, the above-mentioned image forming process may be performed continuously for plural transfer materials P to form images continuously. In the case in which the image formation is performed on plural transfer materials continuously, the image formation for one time is from the start of an image forming process for a first transfer material until the end of an image forming process for a last transfer material.

In the above-mentioned image forming apparatus, a mono-component nonmagnetic toner is used as the yellow toner, the magenta toner, the cyan toner, and the black toner which are the developers contained in the developing devices 4*a* to 4*d* provided in the rotary developing apparatus 4. As described above, the contact development is adopted with which a toner is fed to an electrostatic latent image portion of the photosensitive drum 1 by the rotation of the developing roller 5.

Figure 18:
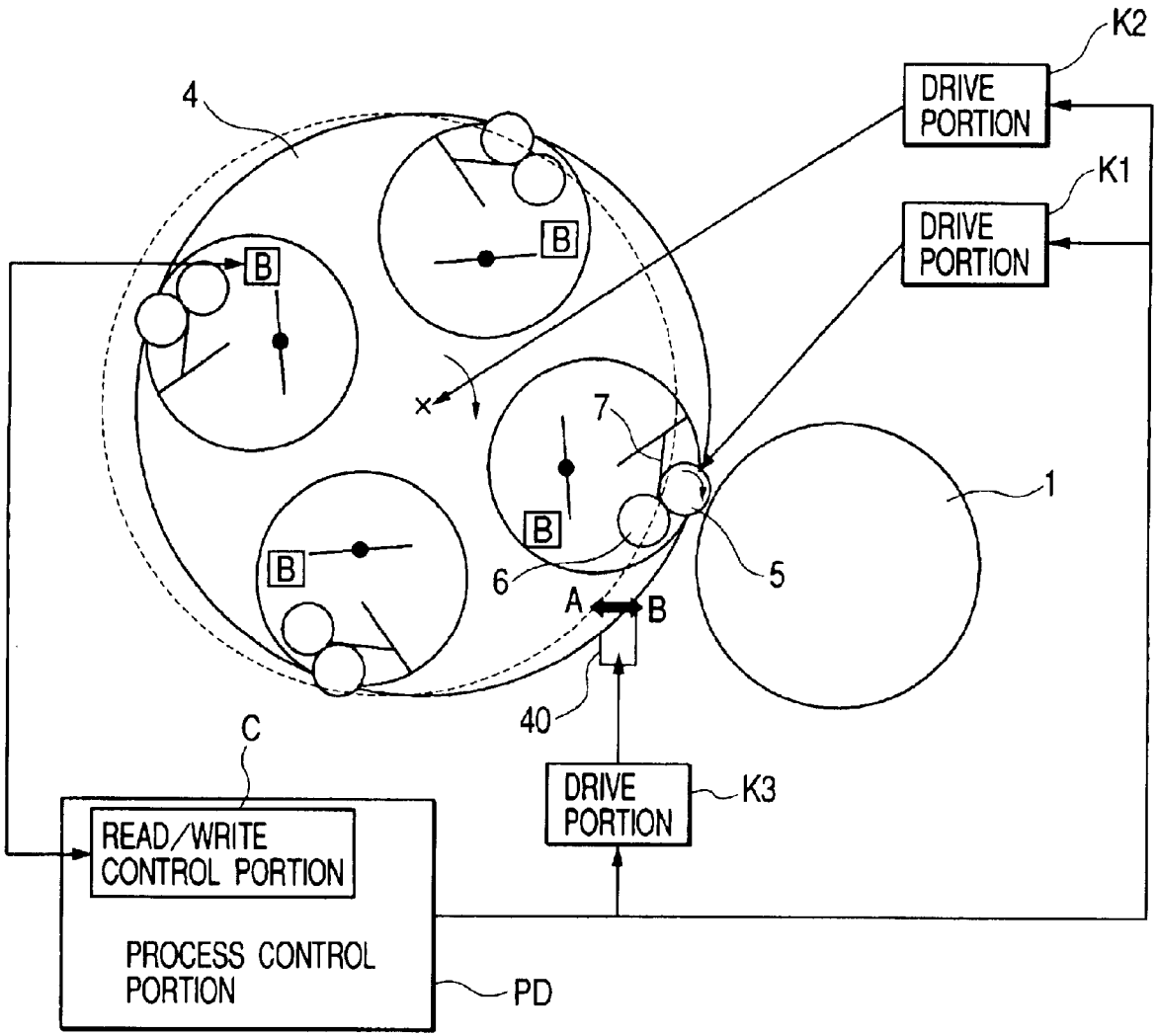
FIG. 18 is a control block diagram of the image forming apparatus in accordance with the present invention.

Here, with reference to FIG. 18, a relation between a process control portion of the image forming apparatus and a drive portion (motor), a development portion, and a rotary developing apparatus will be described briefly.

A process control portion PD sends a drive signal to drive portions K1 to K3, and the drive portion K1 receives the drive signal to drive to rotate the developing roller 5 of the developing portion, and the drive portion K2 receives the drive signal to drive to rotate the rotary developing apparatus 4. As the developing roller 5 rotates, a charge is given to a toner by friction with the developing blade 7. In addition, the contact/separation (clutch) 40 is operated by the drive portion K3, whereby the rotary developing apparatus 4 may be moved in directions of arrows A and B to be brought into abutment against and separated from the photosensitive drum 1.

In addition, the process control portion PD communicates with a memory portion B through a read/write control portion C in the control portion to read information from and write information in the memory portion B provided in each developing device.

Note that, although the above description is about a structure having the plural drive portions, it is possible to perform control with one drive portion.

Next, a toner used in this embodiment will be described.

A toner in accordance with the present invention is, for example, a mono-component nonmagnetic small particle diameter polymerized toner which is manufactured by a suspension polymerization method, has a substantially spherical shape with a particle diameter of approximately 5 to 7 $\mu$m, and contains a low softening point material (wax component).

It is preferable that, in a sectional observation of a toner particle using a transmission electron microscope (TEM), the wax component is dispersed in an island shape as it swells from binding resin in substantially a spherical and/or spindle shape in a state in which the wax component does not mutually dissolve with the binding resin.

Since deterioration of the toner, contamination of the image forming apparatus, and the like can be prevented by dispersing the wax component to be contained in the toner as described above, high chargeability can be maintained, and a toner image excellent in dot reproduction can be formed in a long period of time. In addition, since the wax component acts efficiently at the time of heating, a fixing property at low temperature and an anti-offset property can be made satisfactory.

In the present invention, as a specific method of observing a section of a toner particle, a hardened material, which is obtained by sufficiently dispersing toner particles in cold setting epoxy resin and then hardening it for two days in the atmosphere of 40° C., is subjected to dyeing using ruthenium tetroxide, as well as osminum tetroxide if necessary, and then a flake-like sample is cut out using a microtome provided with diamond teeth, and a sectional form of the toner particle is observed using the transmission electron microscope (TEM).

In the present invention, since materials are contrasted utilizing a slight difference of crystallization of the wax component to be used and resin forming a shell, it is preferable to use a ruthenium tetroxide dyeing method.

As the wax component in accordance with the present invention, a wax component, which has a maximum endothermic peak in a region of 40 to 130° C. at the time of temperature rise in a DSC curve measured by a differential scanning calorimeter, is used. Since the wax component has the maximum endothermic peak in this temperature range, it contributes to low temperature fixing significantly and also effectively manifests release characteristics.

If the maximum endothermic peak is less than 40° C., autoagglutination power of the wax component is weakened and, as a result, an anti-high temperature offset property thereof is deteriorated and, at the same time, gross becomes too high. On the other hand, if the maximum endothermic peak exceeds 130° C., a fixing temperature rises and, at the same time, it becomes difficult to flatten a surface of a fixed image moderately. Therefore, this is not preferable in terms of decrease in a color mixing property, in particular, when the wax component is used in a color toner.

Moreover, in the case in which a toner is directly obtained by a polymerization method by performing granulation and polymerization in a water based medium, a high maximum endothermic peak temperature is not preferable because a problem occurs in that, for example, the wax component separates out into the granulation.

Measurement of the maximum endothermic peak temperature of the wax component is performed according to the "ASTMD3418-8".

For the measurement, for example, DSC-7 manufactured by PerkinElmer Inc. is used. Temperature correction of an apparatus detection portion is performed using the melting points of indium and zinc, and heat of fusion of indium is used for correction of a heat quantity. A pan of aluminum is used for a measurement sample. An empty pan is set for comparison. After taking a pre-history by raising and lowering a temperature once, measurement is performed at a temperature raising speed of 10° C./min.

As the above-mentioned wax component, more specifically, a paraffin wax, a polyolefin wax, a Fischer-Tropsch wax, an amide wax, a higher fatty acid, an ester wax, or a derivative of these, a graft/block compound of these, or the like can be utilized.

In the toner in accordance with the present invention, a value of a shape factor SF1 and a shape factor SF2 measured by an image analysis apparatus are preferably 100 to 160 and 100 to 140, respectively, and more preferably 100 to 140 and 100 to 120, respectively.

In addition, if the above-mentioned conditions are satisfied, and a value of (SF2)/(SF1) is 1.0 or less, not only characteristics of the toner but also matching with the image analysis apparatus becomes extremely favorable.

In order to increase a transfer efficiency of a toner image, it is preferable that the shape factor SF2 is 100 to 140 and the value of (SF2)/(SF1) is 1.0 or less.

SF1 and SF2 indicating the shape factors used in the present invention are defined as values obtained by sampling one hundred toner images, which are magnified by 500 times, at random using FE-SEM (S-800) manufactured by Hitachi, Ltd., and introducing image information thereof into an image analysis apparatus (Luzex3) manufactured by Nicolet Japan Corporation via an interface to be calculated by the following expression.

$$SF1=\{(\mathrm{MXLING})^2/\mathrm{AREA}\}\times(\pi/4)\times 100$$

$$SF2=\{(\mathrm{PERI})^2/\mathrm{AREA}\}\times(1/4\pi)\times 100$$

Figure 2:
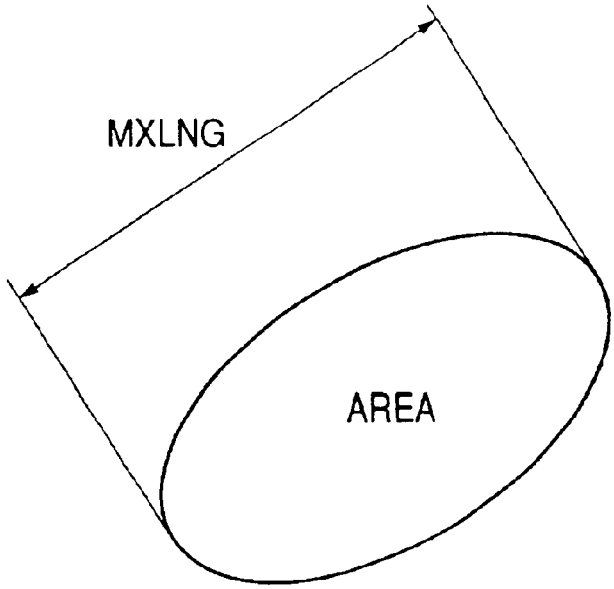
FIG. 2 is an explanatory diagram showing a shape of a developer (toner) in accordance with the present invention.
Figure 3:
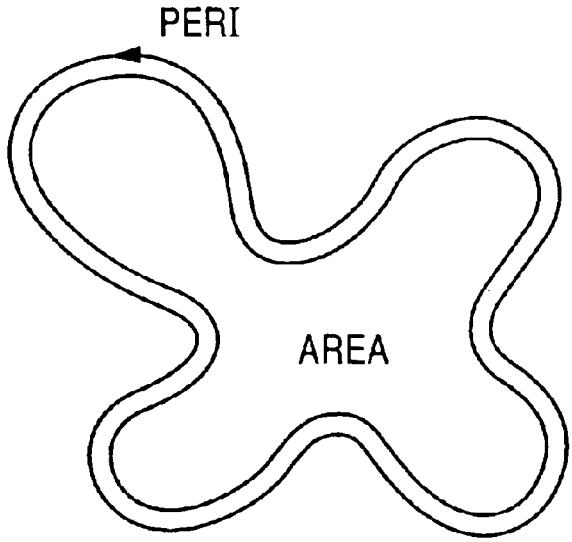
FIG. 3 is an explanatory diagram showing a shape of a developer (toner) in accordance with the present invention.

AREA: Toner projection area
MXLNG: Absolute maximum length
PERI: Peripheral length As it is understood if MXLNG and AREA in a toner shape shown in FIG. 2 and the above expression of SF1 are referred to, the shape factor SF1 of the toner indicates a degree of roundness of a toner particle. When a numerical value thereof increases, the toner particle gradually deforms from a sphere. As it is understood if PERI and AREA in a toner shape shown in FIG. 3 and the above expression of SF2 are referred to, SF2 indicates a degree of unevennesses of a toner particle. When a numerical value thereof increases, unevennesses of a toner surface become conspicuous.

In the case in which the shape factor SF1 exceeds 160, a torque increases or a friction increases because a rolling resistance decreases. Thus, frictional heat increases to easily cause thermal degradation. In addition, in the case in which the shape factor SF2 exceeds 140 and the value of (SF2)/(SF1) exceeds 1.0, a surface of a toner particle is not smooth but has a lot of unevennesses. Thus, a transfer efficiency from the photosensitive drum 1 to the transfer material P tends to decrease.

Moreover, as a toner particle used in the present invention, it is preferable that a toner particle with a surface thereof coated by an extraneous additive is used, and a predetermined amount of charging is given to the toner.

In that sense, a coating rate of the extraneous additive on the toner surface is preferably 5 to 99%, and more preferably 10 to 99%.

The coating rate of the extraneous additive on the toner surface is obtained by sampling one hundred toner images at random using FE-SEM (S-800) manufactured by Hitachi, Inc. and introducing image information thereof into the image analysis apparatus (Lusex3) manufactured by Nicolet Japan Corporation via an interface.

Since brightness of a toner particle surface part and an extraneous additive part is different, image information to be obtained is binarized to find an area of an extraneous additive part SG and an area of a toner particle part (including an area of the extraneous additive part) ST, separately, and the coating rate of the extraneous additive is calculated according to the following expression.

$$\text{Coating rate of the extraneous additive } (\%)=(SG/ST)\times 100$$

From the viewpoint of durability at the time when it is added to a toner, the extraneous additive used in the present invention preferably has a particle diameter equal to or less than 1/10 of a weight average diameter of toner particles. This particle diameter of the extraneous additive means an average particle diameter of toner particles found by surface observation of the toner particles with an electronic microscope.

As the extraneous additive, for example, metal oxide (aluminum oxide, titanium oxide, strontium titanate, cerium oxide, magnesium oxide, chrome oxide, tin oxide, zinc oxide), nitride (silicon nitride, etc.), carbide (silicon carbide), metal salt (calcium sulfate, barium sulfate, calcium carbonate), fatty acid metal salt (zinc stearate, calcium stearate), carbon black, silica, or the like is used.

In the present invention, auxiliary particles were extraneously added to toner particles (100 part by weight). The extraneously added auxiliary particles were 1 part by weight of silica as a negative polarity extraneous additive and 0.1 part by weight of titanium oxide as a positive polarity extraneous additive. In particular, in the case in which the positive polarity extraneous additive was added, it is possible to adjust liquidity of the toner and give chargeability to the toner.

0.01 to 10 parts by weight, and more preferably 0.05 to 5 parts by weight of the extraneous additive are used with respect to 100 parts by weight of the toner particles.

In the case in which an added amount of the extraneous additive is less than 0.01 part by weight, liquidity of a mono-component developer deteriorates, an efficiency of transfer and development falls, and unevenness of an image density and scattering of the toner to the vicinity of an image portion occur.

On the other hand, in the case in which an amount of the extraneous additive exceeds 10 parts by weight, an excessive extraneous additive deposits on a photosensitive drum or a developing roller to deteriorate chargeability of the toner or deteriorate an image.

The extraneous additive may be used individually or may be used in plural forms. In addition, an extraneous additive subjected to hydrophobic treatment is more preferably used.

In the image forming apparatus adopting the contact development using the mono-component nonmagnetic toner as in this embodiment, image failure such as insufficiency of an image density and non-uniformity of an image density due to insufficiency of a toner charging amount as described in the conventional example may occur.

Thus, in the present invention, as shown in FIG. 1, the developing devices 4*a* to 4*d* are provided with the memory portion B serving as storage means such as a flash memory capable of recording and referring to an image formation history in addition to the developing roller 5, the supply roller 6, the developing blade 7, the agitating member 8, and the like, respectively. The memory portions B of the developing devices 4*a* to 4*d* used in the image formation of the last time store a finish time of the image formation of the last time which was performed in accordance with the above-mentioned image forming process. In the case of developing means which is used for the first time since the image forming apparatus was manufactured, it is recorded in the memory portion B of the developing means that there is no image formation history.

In addition, before starting the image formation for one time including the continuous image formation, there is a preparation process called pre-rotation for heating or the like of a fixing device, which is performed after an image forming instruction is transmitted from a host apparatus such as a personal computer (not shown).

Then, in the manufactured image forming apparatus, if the image formation using certain developing means is image formation of second and subsequent times, when image formation for one time using this developing means is started, in the preparation process, a lapsed time from a finish time of the image formation of the last time stored in the storage means until a time of transmission of an image formation command from the host apparatus such as the personal computer (not shown) of this time is calculated. A rotation time of the developing roller in the developing means is controlled by the control method in accordance with the present invention as described later with reference to a flowchart of FIG. 5 according to the calculated lapsed time, whereby insufficiency of a charging amount of the toner may be prevented.

Next, communication between the memory portion B provided in the developing device of the image formation apparatus and an image forming apparatus main body relating to the control method for the image forming apparatus of the present invention will be described with reference to FIG. 4.

A storage portion F for storing information is provided in the memory portion B. As described above, any element can be applied to this storage portion F as long as the element is a nonvolatile storage element such as a flash memory, an EEPROM, or an FERAM (ferroelectric memory). This memory portion B can be accessed by reading/writing means (read/write control portion) C provided in the image forming apparatus A.

The image forming apparatus A includes a process control portion PD for controlling image formation, and the process control portion PD includes a read/write control portion C for accessing the storage portion F of the memory portion B to read out information or performing writing control. In this embodiment, date information (date and time) at a point when an image forming process of the image forming apparatus A has finished is stored in a predetermined area of the storage portion F.

In addition, instead of the read/write control portion C, the process control portion PD (CPU) controlling a process of the image forming apparatus A may perform read/write control, or a separate dedicated control portion may be provided to control reading and writing.

Further, the communication between the read/write control portion C and the memory portion B may be performed by connecting signal lines (or bringing signal lines into contact with each other) or may adopt a system for communication with wireless communication such as communication by electromagnetic wave using an antenna or optical communication.

Figure 5:
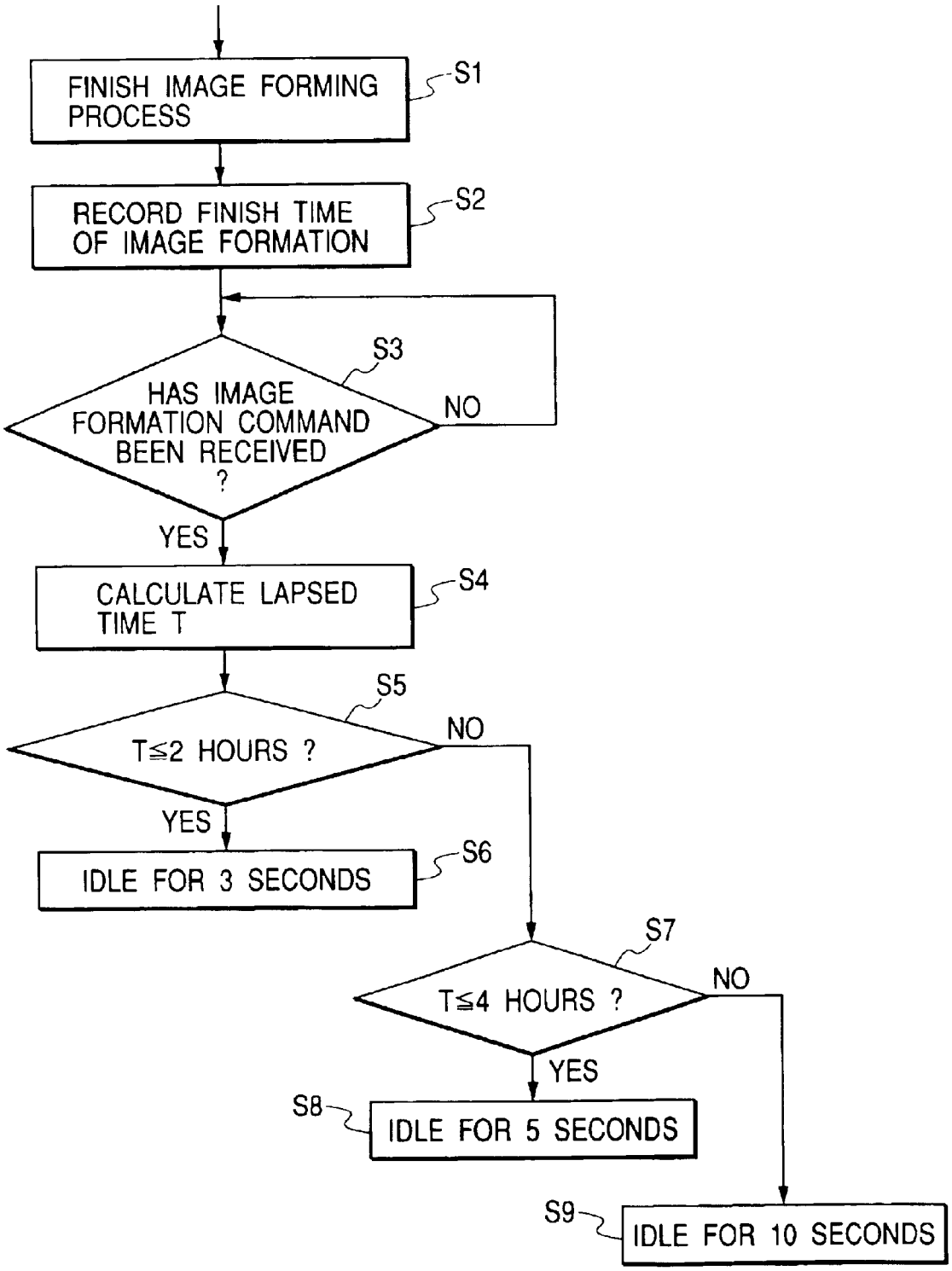
FIG. 5 is a flowchart showing a control method for an image forming apparatus in accordance with a first embodiment of the present invention.

Here, an operation in accordance with the control method for the image forming apparatus in accordance with the present invention, in particular, an operation in accordance with the control method in the preparation process before image formation for one time will be described with reference to the flowchart of FIG. 5.

Note that, it is assumed that the image formation for one time means, as described above, an operation for performing an image forming process on one transfer material P or an operation for repeatedly applying the image forming process to plural transfer materials P. Further, a time before the image formation for one time when the preparation process is performed means a time slot from a time when an image formation command is transmitted from the host apparatus such as the host computer (not shown) until at least a time when an electrostatic latent image is formed on the photosensitive drum 1 and the developing means to be started, that is, the developing device 4*a* of the first color operates.

First, immediately after the previous image formation for one time is finished in step S1, a finish time of image formation is recorded in recording media of the respective developing devices 4*a* to 4*d* by the read/write control portion C of the image forming apparatus A in step S2. Note that, here, it is assumed that all of the developing devices 4*a* to 4*d* were used in the image formation of the last time.

Note that, at this point, the developing roller 5 is separated from the photosensitive drum 1 by the contact/separation mechanisms 40 of the developing devices 4*a* to 4*d*.

Next, when a new image formation command is transmitted from the host apparatus such as the personal computer and received in step S3, a lapsed time T from the finish time of the image formation of the last time, which is recorded in the storage means B via the read/write control portion C, until a start time of image formation of this time, which is a time when the image formation command of this time is received, is calculated in step S4. According to a value of T, a time, during which the developing roller 5 should be idled in the preparation process to be performed before the image formation of this time, is determined. Note that idle means an operation for rotating the developing roller 5 in a state in which the rotary developing apparatus 4 is separated from the photosensitive drum 1. A charge is given to a toner by this operation.

Then, for example, in the case in which T is three hours, it is judged NO in step S5 for judging if T is equal to or shorter than two hours, and the processing proceeds to step S7 for judging whether or not T is equal to or shorter than four hours. In step S7, since it is judged YES, the processing proceeds to step S8, where the developing rollers 5 mounted on the respective developing devices 4*a* to 4*d* are idled for five seconds in a direction of an arrow.

First, the first developing device 4*a* containing the yellow toner moves to the development position opposed to the photosensitive drum 1, and the developing roller 5 is driven to rotate for five seconds by a motor (not shown) in a state in which the developing roller 5 is separated from the surface of the photosensitive drum 1.

When this operation is finished, the developing apparatus 4 rotates in the direction of the arrow again. The second developing device 4*b* containing the magenta toner moves to the development position opposed to the photosensitive drum 1, and the developing roller 5 is driven to rotate for five seconds by the motor (not shown) in a state in which the developing roller 5 is separated from the surface of the photosensitive drum 1.

Thereafter, as to the third developing device 4*c* containing the cyan toner and the fourth developing device 4*d* containing the black toner, the respective developing rollers 5 are driven to rotate for five seconds by the motor (not shown) in the same manner as described above. Then, a normal image forming process is started.

In the case in which it is judged YES in step S5 for judging whether or not T is equal to or shorter than two hours, the processing proceeds to step S6, where the developing roller 5 is driven to rotate for three seconds. In addition, in the case in which it is judged NO in step S7 for judging whether or not T is equal to or shorter than four hours, the processing proceeds to step S9, where the developing roller 5 is driven to rotate for ten seconds.

Note that ON/OFF of rotation is controlled by the process control means PD in the image forming apparatus A.

As described above in accordance with the flowchart of FIG. 5, in the control method for the image forming apparatus of the present invention, there is provided a step in which storage means provided in developing means stores a time when image formation for one time using this developing means is finished, and a time lapsed from a time when an image forming process of the last time is finished until a time when the next image formation is started is calculated in a preparation step before the next image formation for one time. Further, there is provided a step of determining a rotation time of a developing roller in rotation according to a length of a lapsed time which is a time interval between the finish and the start of this image formation.

Note that, in developing means which is used for the first time since the image forming apparatus was manufactured, it is judged NO in step S7 for judging whether or not T is equal to or shorter than four hours, and the developing roller 5 is rotated for ten seconds.

Consequently, for example, even in the case in which image formation is performed after a toner is left as it is for a long time, it becomes possible to give a sufficient charge to the toner in advance before an image forming process, and it becomes possible to prevent occurrence of an image failure such as a low image density or a non-uniform image density.

In addition, since an idle process of the developing roller is performed in a state in which the developing roller is separated from a surface of a photosensitive drum, it also becomes possible to prevent occurrence of an image failure such as unnecessary transfer of a toner onto the surface of the photosensitive drum or scattering of the toner in the apparatus.

In the above description, image formation is performed using all of the four developing devices 4*a* to 4*d*. However, there is a case in which not all the developing devices are used such as at a time of single color image formation, and in this case, there are developing devices which do not operate. In such a case, although the lapsed time T may be different for the respective developing devices, since the storage means B storing an image history is provided for each developing device, the operation as shown in FIG. 5 can be performed for each developing device to calculate the lapsed time T for the developing device and decide a rotation time in a preparation process in the developing device.

Second Embodiment

Another embodiment of the image forming apparatus and the control method therefor in accordance with the present invention will be hereinafter described. Members identical with those described in the first embodiment will be denoted by identical reference symbols, and a description thereof will be omitted.

The image forming apparatus of this embodiment is characterized in that developer remaining amount detection means (toner amount detection means) for detecting an amount of toner remaining in the respective developing devices 4*a* to 4*d* is provided, and a time for idling of the developing rollers 5 of the respective developing devices 4*a* to 4*d*, which is performed in the preparation process before image formation for one time in accordance with the control method of the image forming apparatus, is variable according to the amount of toner remaining in the respective developing devices 4*a* to 4*d*.

It is an object of this embodiment to adjust the idling time of the developing rollers according to the amount of toner remaining in the developing devices 4*a* to 4*d* to perform control such that excessive stress is not exerted on the toner. A charge imparting property to a toner at the time of development varies depending upon an amount of toner remaining in a developer. That is, in the case in which the remaining amount of toner is large and it is relatively difficult to uniformly give a charge, a sufficient amount of charge is given by setting the idling time of the developing rollers 5 long. In addition, in the case in which the remaining amount of toner is small and it is relatively easy to uniformly give a charge, the idling time of the developing rollers 5 is set short.

As the developer remaining amount detection means (toner amount detection means) for detecting an amount of toner remaining in the respective developing devices 4*a* to 4*d*, a well-known piezoelectric sensor system, magnetic sensor system, optical detection system, antenna detection system, or the like is used. In this embodiment, an optical detection means is used. With the optical detection means, as shown in FIG. 6, a light-emitting element 21 for radiating light such that the light passes through a predetermined part of the developing devices 4*a* to 4*d* and a light-receiving element 22 for receiving the light are disposed in the image forming apparatus A, a translucent window 23 is provided on an optical path of the developing devices 4*a* to 4*d*, the translucent window 23 is wiped in synchronization with the rotation of the agitating member 8 for the toner, and at that point, a remaining amount of toner in the developing device is detected according to a change in an amount of received light to be detected.

Note that the light-emitting element 21 and the light-receiving element 22 may be provided anywhere in the image forming apparatus and in how many pairs, or may be provided in four pairs in total, one for each of the developing devices 4*a* to 4*d*, or may be provided in only one pair such that light passes through windows of all the developing devices 4*a* to 4*d*.

Figures 6, 7A, 7B:
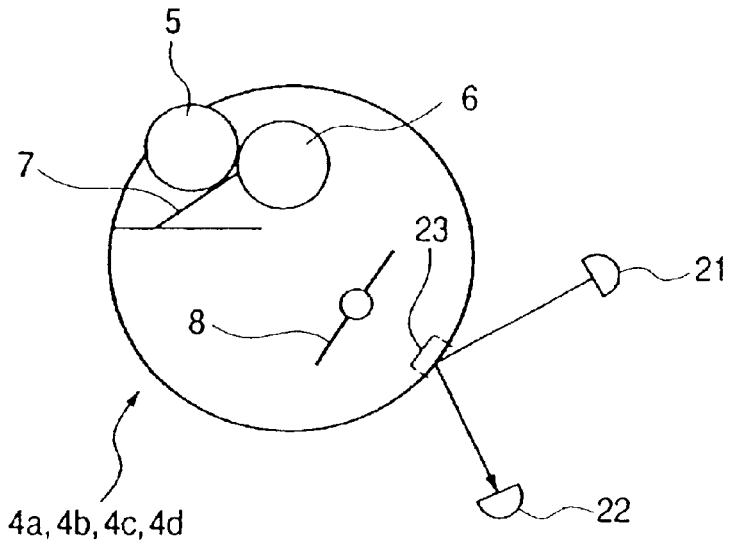
FIG. 6 is a schematic diagram showing developing means in a second embodiment of the present invention.
FIGS. 7A and 7B are explanatory diagrams showing a storage portion of storage means in the second embodiment of the present invention.

FIGS. 7A and 7B shows that toner remaining amount information M is also stored in the storage portion F of the memory portion B in addition to date information (date and time) at a point when an image forming process of the image forming apparatus is finished. In the case in which a remaining amount of toner is not detected, as shown in FIG. 7A, a finish time of image formation and the number of printed sheets are stored. However, when a remaining amount of toner is detected, as shown in FIG. 7B, the remaining amount of toner is written subsequently to the finish time of image formation.

Figure 8:
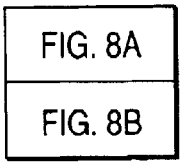
FIG. 8 is comprised of FIGS. 8A and 8B which are flowcharts showing a control method for an image forming apparatus in accordance with the second embodiment of the present invention.
Figure 8A:
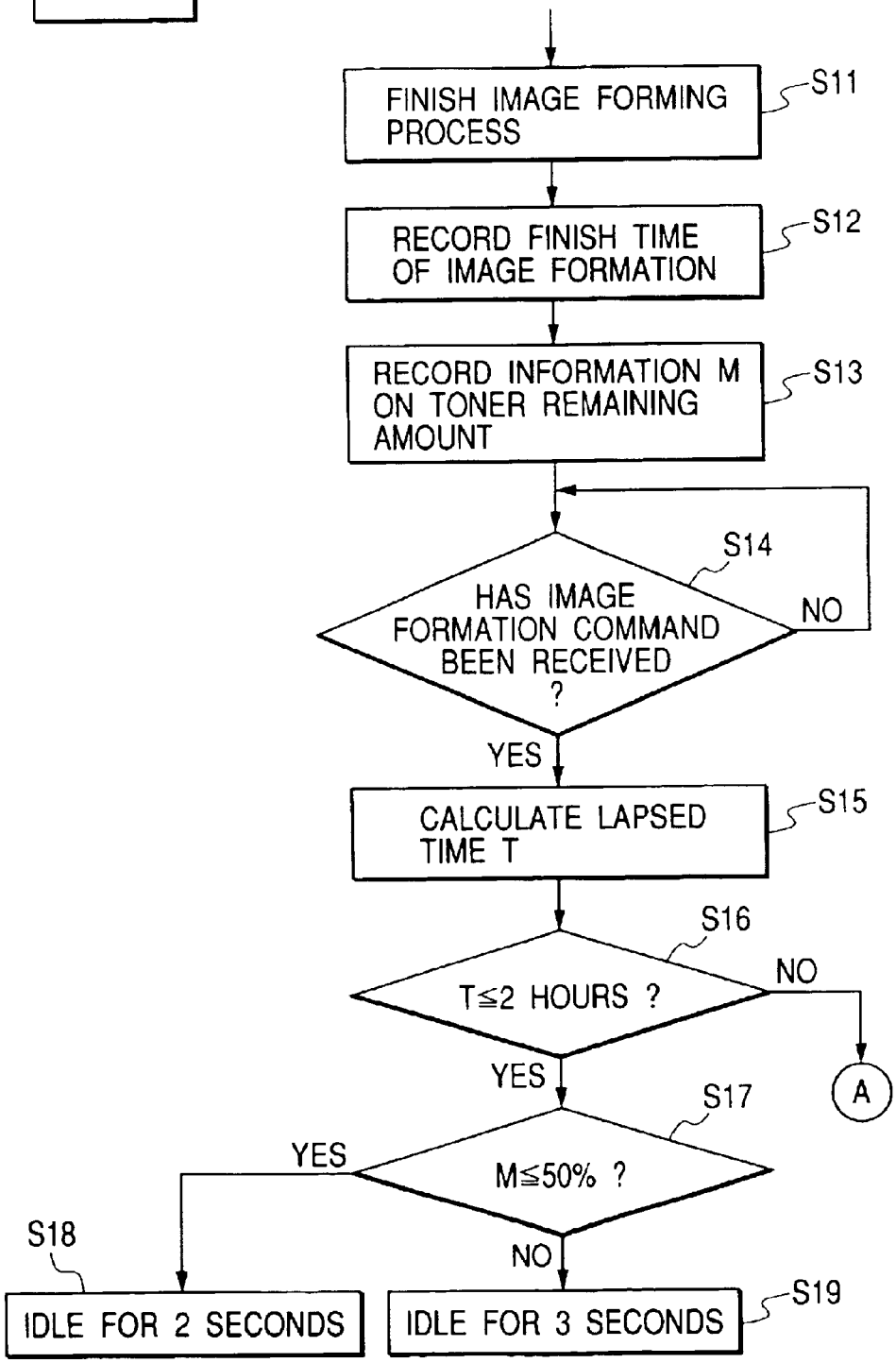
Figure 8B:
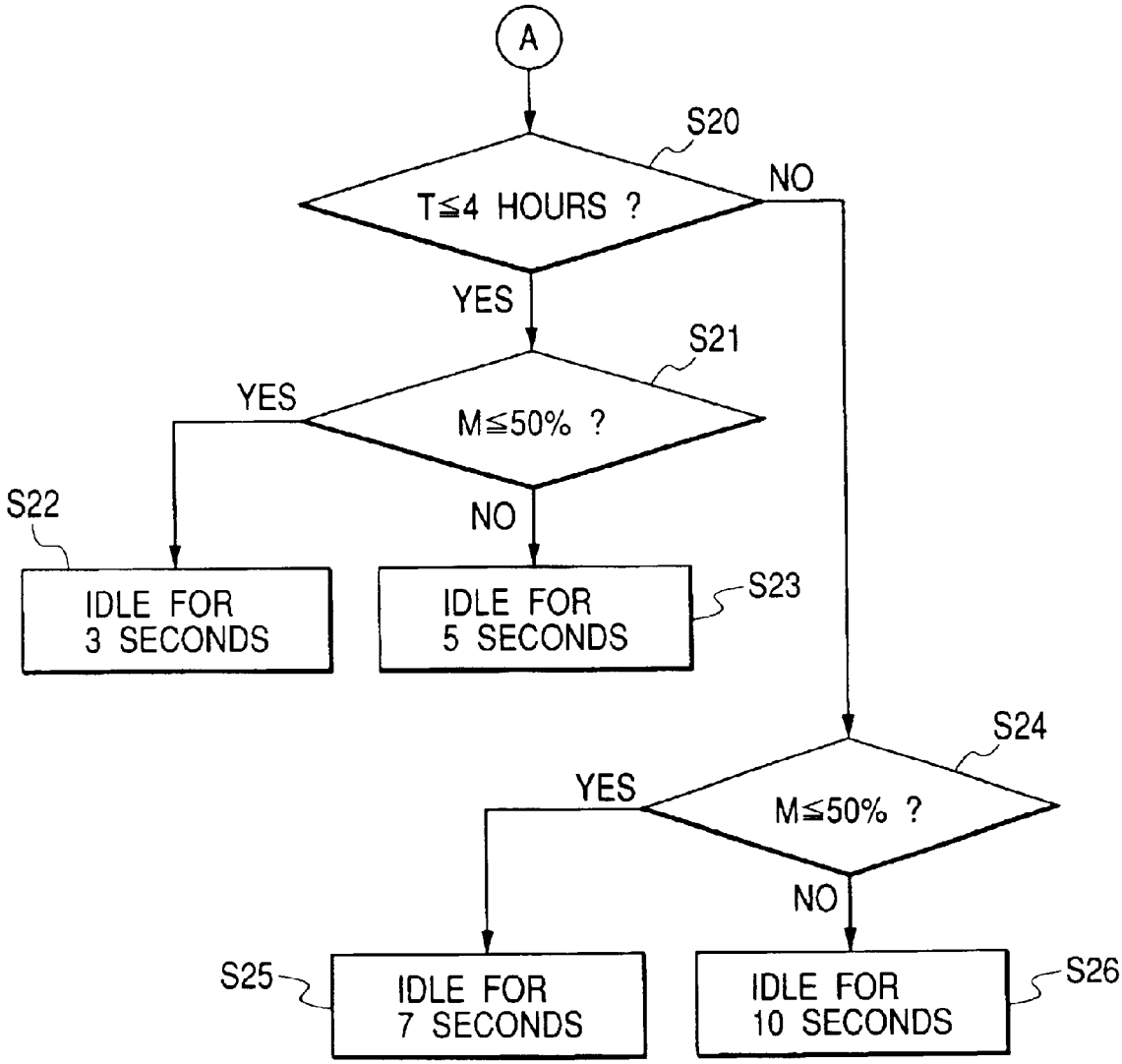

Here, an operation in accordance with the control method for the image forming apparatus in accordance with the present invention, in particular, an operation in accordance with the control method in the preparation process before image formation will be described with reference to FIGS. 8A and 8B.

Figure 4:
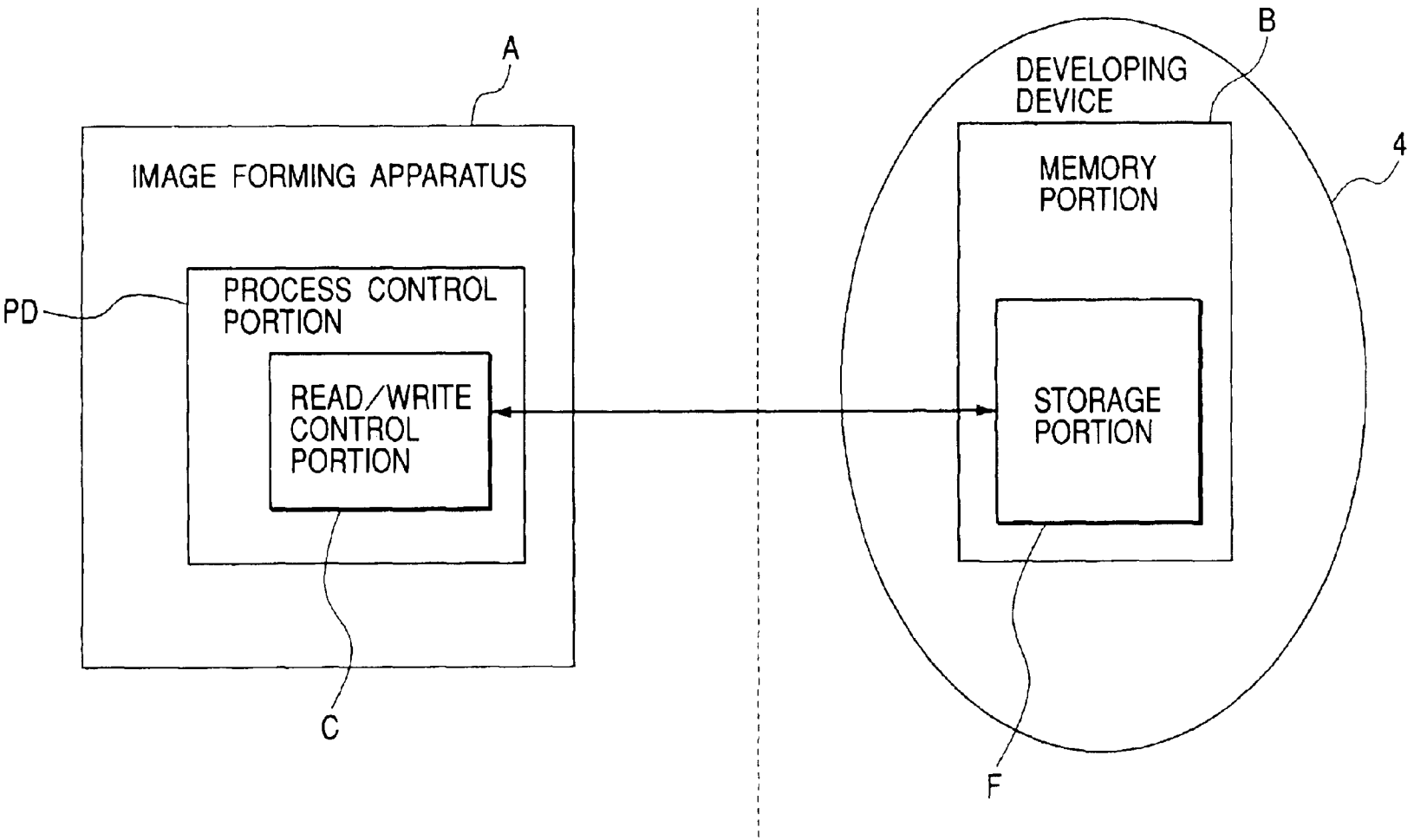
FIG. 4 is a block diagram showing storage means in accordance with the present invention.

First, immediately after an image forming process currently being performed is finished in step S11, a finish time of image formation is recorded in the storage portions F of the memory portions B of the respective developing devices 4*a* to 4*d* by the read/write control portion C shown in FIG. 4, which is reading/writing means of the image forming apparatus, in step S12. Then, toner remaining amount information M in the respective developing devices 4*a* to 4*d* detected by the toner remaining amount detection means is recorded in step S13.

Note that the developing rollers 5 are separated from the photosensitive drum 1 by the contact/separation mechanisms 40 of the developing devices 4*a* to 4*d* at this point.

Next, upon receiving a new image formation command from the host apparatus such as the personal computer in step S14, a lapsed time T from the finish time of previous image formation recorded in the storage means B via the read/write control portion C is calculated in step S15, and a time during which the developing rollers 5 should be idled before an image forming process is determined according to a value of T and a value of the toner remaining amount information M read out simultaneously.

Then, for example, in the case in which T is three hours, and a remaining amount of the yellow toner is 40% and a remaining amount of the magenta toner is 80%, it is judged NO in step S16 for judging whether or not T is equal to or shorter than two hours, and the processing proceeds to step S20 for judging whether or not T is equal to or shorter than four hours, where it is judged YES, and the processing proceeds to step S21. Moreover, since the yellow toner remains 40%, in the case of the yellow toner, it is judged YES in step S21 for judging whether or not M is equal to or smaller than 50%, and the processing proceeds to step S22. Thus, first, the developing device 4*a* containing the yellow toner rotates in the direction of an arrow in FIG. 1 to move to the development position opposed to the photosensitive drum 1, and the developing roller 5 is driven to idle for three seconds by the motor (not shown) in a state in which the developing roller 5 is separated from the surface of the photosensitive drum 1.

When this processing is finished, next, in this embodiment, in the case of the magenta toner, since it is judged NO in step S21 for judging whether or not M is equal to or less than 50%, the processing proceeds to step S23. The second developing device 4*b* containing the magenta toner rotates in the direction of the arrow in FIG. 1 to move to the development position opposed to the photosensitive drum 1 and is driven to idle for five seconds by the motor (not shown) in a state in which the developing roller 5 is separated from the surface of the photosensitive drum 1.

Thereafter, as to the third developing device 4*c* containing the cyan toner and the fourth developing device 4*d* containing the black toner, the respective developing rollers 5 are driven to idle for a time corresponding to the remaining amount of toner by the motor (not shown) in the same manner as described above. Then, a normal image forming process is started.

In the image forming apparatus of this embodiment, when it is judged that T is equal to or shorter than two hours in step S16, the processing proceeds to step S17 for judging whether or not M is equal to or less than 50%. If it is judged YES, the developing roller 5 is idled for two seconds in step S18. If it is judged NO, the processing proceeds to step S19, where the developing roller 5 is idled for three seconds.

Then, in the case in which a lapsed time from finish of the image formation of the last time is long and it is judged NO in step S20 for judging whether or not T is equal to or shorter than four hours, the processing proceeds to step S24 for judging whether or not M is equal to or smaller than 50%. If it is judged YES, the developing roller 5 is idled for seven seconds in step S25. If it is judged NO, the developing roller 5 is idled for ten seconds in step S26.

As described above, in this embodiment, in the control method for the image forming apparatus, there is provided a step of determining an idling time based upon the lapsed time T and the toner remaining amount information M in the developing device.

In this way, control correlated to a remaining amount of toner as well as a lapsed time after finish of image formation of the last time is performed, whereby, even in the case in which image formation is performed after a toner is left as it is for a long time, it becomes possible to give a sufficient charge to the toner in advance before the image formation for each color, and it becomes possible to prevent occurrence of an image failure such as a low image density or a non-uniform image density.

In addition, since an idling process of the developing roller is performed in a state in which the developing roller is separated from the surface of the photosensitive drum, it also becomes possible to prevent occurrence of an image failure such as unnecessary transfer of a toner onto the surface of the photosensitive drum or scattering of the toner in the apparatus.

Note that the idling time of the developing roller according to the remaining amount of toner described in this embodiment is only an example and is not limited to this.

Third Embodiment

Another embodiment of the image forming apparatus and the control method therefor in accordance with the present invention will be hereinafter described. Members identical with those described in the first embodiment will be denoted by identical reference symbols, and a description thereof will be omitted.

The image forming apparatus of this embodiment is characterized in that a developer remaining amount detection means, which automatically detects a temperature and humidity environmental state around a place where the image forming apparatus is installed, is provided, and a time for idling of the developing roller 5 of the respective developing devices 4*a* to 4*d* to be performed in the preparation process before image formation is variable according to environmental information detected by the developer remaining amount detection means.

It is an object of this embodiment to perform control such that excessive stress is not exerted on the toner due to an environmental state around a place where the image forming apparatus is installed. A charge imparting property to a toner varies depending upon the environmental state around a place where the image forming apparatus is installed. In the case in which it is relatively difficult to uniformly give a charge as under a high temperature and high humidity environment, a sufficient amount of charge is given by setting the idling time of the developing rollers long. In addition, in the case in which it is relatively easy to uniformly give a charge as under a low temperature and low humidity environment, the idling time of the developing rollers is set short.

First, this environment detection means will be described. In the image forming apparatus in this embodiment, the charging roller 2 as shown in FIG. 1 is provided as charging means. In general, a material forming the charging roller 2 has a characteristic that a resistance value thereof changes according to ambient environmental states. Under a low temperature and low humidity environment, the resistance value of the charging roller 2 tends to increase compared with that under a normal temperature and normal humidity environment. On the contrary, under a high temperature and high humidity environment, the resistance value of the charging roller 2 tends to decrease compared with that under the normal temperature and normal humidity environment. Thus, by detecting the resistance value of the charging roller 2, it becomes possible to recognize an environmental state around a place where the image forming apparatus is installed, which is effective as the environment detection means.

Figure 9:
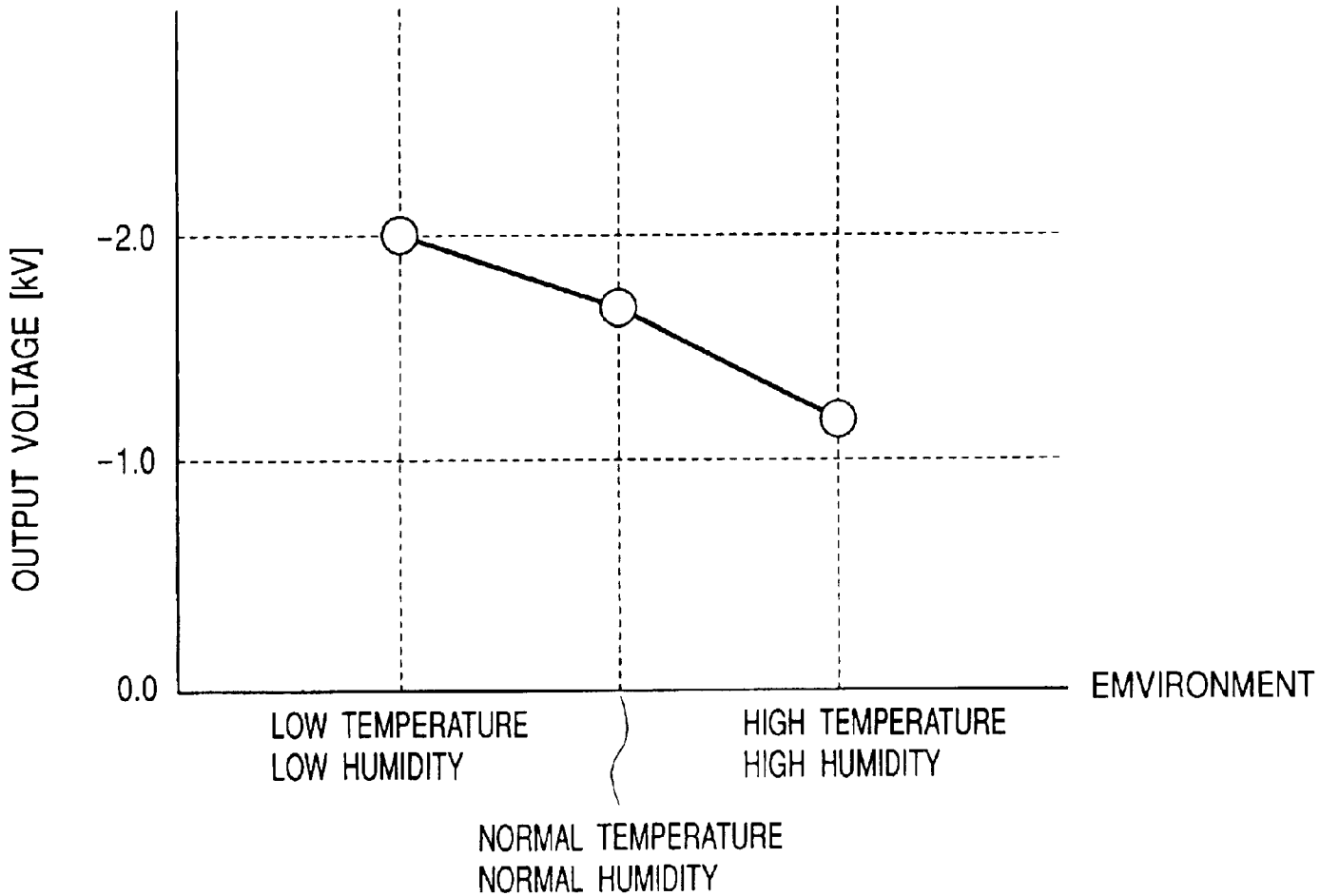
FIG. 9 is a graph showing a relation between an output voltage and a temperature and humidity environment at the time when a constant current is applied to a charging roller.

Here, FIG. 9 shows an experimental result concerning environmental dependency of a voltage generated when a DC bias controlled to a constant current of −20 μA is applied to the charging roller 2 when the image forming apparatus in accordance with this embodiment is used and the charging roller 2 abuts against a non-image forming area of the rotating photosensitive drum 1.

According to this experimental result, a generated voltage under the normal temperature and normal humidity environment is −1.7 kV, whereas, since the resistance value of the charging roller 2 is relatively high under the low temperature and low humidity environment, a voltage generated at this point is as high as −2.0 kV. On the contrary, under the high temperature and high humidity environment, since the resistance value of the charging roller 2 is relatively low, a voltage generated at this point is as low as −1.2 kV.

Thus, by detecting whether the generated voltage is higher or lower than a value set in advance, while taking into account fluctuation of the resistance value of the charging roller 2, it becomes possible to distinguish an environmental state around a place where the image forming apparatus is installed.

Therefore, in this embodiment, a lower limit value of an output voltage for judging that the ambient environmental state is the low temperature and low humidity environment is set to −1.8 kV, and an upper limit value of an output voltage for judging that the ambient environmental state is the high temperature and high humidity environment is set to −1.3 kV.

Here, an operation in accordance with the control method for the image forming apparatus in accordance with the present invention, in particular, an operation in accordance with the control method in the preparation process before an image forming process will be described with reference to flowcharts of FIGS. 10A and 10B.

First, immediately after an image forming process currently being performed is finished in step S101, a finish time of image formation is recorded in the storage portions F of the memory portions B of the respective developing devices 4*a* to 4*d* by the read/write control portion C of the image forming apparatus A in step S102.

Note that the developing rollers 5 are separated from the photosensitive drum 1 by the contact/separation mechanisms 40 of the developing devices 4*a* to 4*d* at this point.

Next, upon receiving a new image formation command from the host apparatus such as the personal computer in step S103, a lapsed time T from the finish time of previous image formation recorded in the storage means B via the read/write control portion C is calculated in step S104, and a time during which the developing rollers 5 should be idled before an image forming process is determined according to a value of T and ambient environmental information obtained by using the charging roller 2 provided in the image forming apparatus A as described above.

Then, when the charging roller 2 abuts against the non-image forming area of the rotating photosensitive drum 1 in step S105, a DC bias controlled to a constant current of −20 μA is applied to the charging roller 2 in step S106.

A case in which T is five hours will be described as an example. In the case in which the environmental state is the high temperature and high humidity environment, that is, when the DC bias controlled to a constant current of −20 μA is applied to the charging roller 2 in step S106, an output voltage value |V| at that time is judged in step S107.

In the case that an output voltage V satisfies |V|<1.3 in step S107, and in the case that a lapsed time T from a finishing time of a preceding image forming step satisfies T≦2 hours in step S108, the developing roller is idled for five seconds in step 109.

In the case that an output voltage V satisfies |V|<1.3 in the step S107, and in the case that a lapsed time T from a finishing time of a preceding image forming step does not satisfy T≦2 hours in step S108, and in the case that the lapsed time T satisfies T≦4 hours in step S110, the developing roller is idled for eight seconds in step S111.

In the case that an output voltage V satisfies |V|<1.3 in the step S107, and in the case that a lapsed time T from a finishing time of a preceding image forming step does not satisfy T≦2 hours in step S108, and in the case that the lapsed time T does not satisfy T≦4 hours in step S110, the developing roller is idled for fifteen seconds in step S112.

In the case that an output voltage V satisfies 1.3≦|V|≦1.8 in step S107, a determination of whether a lapsed time T from a finishing time of a preceding image forming step satisfies T≦2 hours is effected in step S113.

In the case that an output voltage V satisfies 1.3≦|V|≦1.8 in step S107, and in the case that a lapsed time T from a finishing time of a preceding image forming step satisfies T≦2 hours in step S113, the developing roller is idled for three seconds in step S114.

In the case that an output voltage V satisfies 1.3≦|V|≦1.8 in step S107, and in the case that a lapsed time T from a finishing time of a preceding image forming step does not satisfy T≦2 hours in step S113, a determination of whether the lapsed time T satisfies T≦4 is effected in step S115.

In the case that an output voltage V satisfies 1.3≦|V|≦1.8 in step S107, and in the case that a lapsed time T from a finishing time of a preceding image forming step does not satisfy T≦2 hours in step S113, and in the case that the lapsed time T satisfies T≦4 hours in step S115, the developing roller is idled for five seconds in step S116.

In the case that an output voltage V satisfies 1.3≦|V|≦1.8 in step S107, and in the case that a lapsed time T from a finishing time of a preceding image forming step does not satisfy T≦2 hours in step S113, and in the case that the lapsed time T does not satisfy T≦4 hours in step S115, the developing roller is idled for ten seconds in step S118.

In the case that an output voltage V satisfies 1.8≦|V| in step S107, a determination of whether a lapsed time T from a finishing time of a preceding image forming step satisfies T≦2 hours is effected in step S119.

In the case that an output voltage V satisfies 1.8≦|V| in step S107, and in the case that a lapsed time T from a finishing time of a preceding image forming step satisfies T≦2 hours in step S119, the developing roller is idled for two seconds in step S120.

In the case that an output voltage V satisfies 1.8≦|V| in step S107, and in the case that a lapsed time T from a finishing time of a preceding image forming step does not satisfy T≦2 hours in step S119, a determination of whether the lapsed time T satisfies T≦4 hours is effected in step S121.

In the case that an output voltage V satisfies 1.8<|V| in step S107, in the case that a lapsed time T from a finishing time of a preceding image forming step does not satisfy T≦2 hours in step S119, and in the case that the lapsed time T does not satisfy T≦4 hours in step S121, the developing roller is idled for eight seconds in step S122.

In the case that an output voltage V satisfies 1.8<|V| in step S107, in the case that a lapsed time T from a finishing time of a preceding image forming step does not satisfy T≦2 hours in step S119, and in the case that the lapsed time T satisfies T≦4 hours in step S121, the developing roller is idled for four seconds in step S123.

First, the first developing device 4*a* containing the yellow toner is moved to the development position opposed to the photosensitive drum 1, and the developing roller 5 is driven to idle for fifteen seconds by the motor (not shown) in a state in which the developing roller 5 is separated from the surface of the photosensitive drum 1.

When this processing is finished, the developing apparatus 4 rotates in the direction of the arrow again. The second developing device 4*b* containing the magenta toner is moved to the development position opposed to the photosensitive drum 1, and the developing roller 5 is driven to idle for fifteen seconds by the motor (not shown) in a state in which the developing roller 5 is separated from the surface of the photosensitive drum 1.

Thereafter, as to the third developing device 4*c* containing the cyan toner and the fourth developing device 4*d* containing the black toner, the respective developing rollers 5 are driven to idle for fifteen seconds by the motor (not shown) in the same manner as described above. Then, a normal image forming process is started.

Figures 10, 10A:
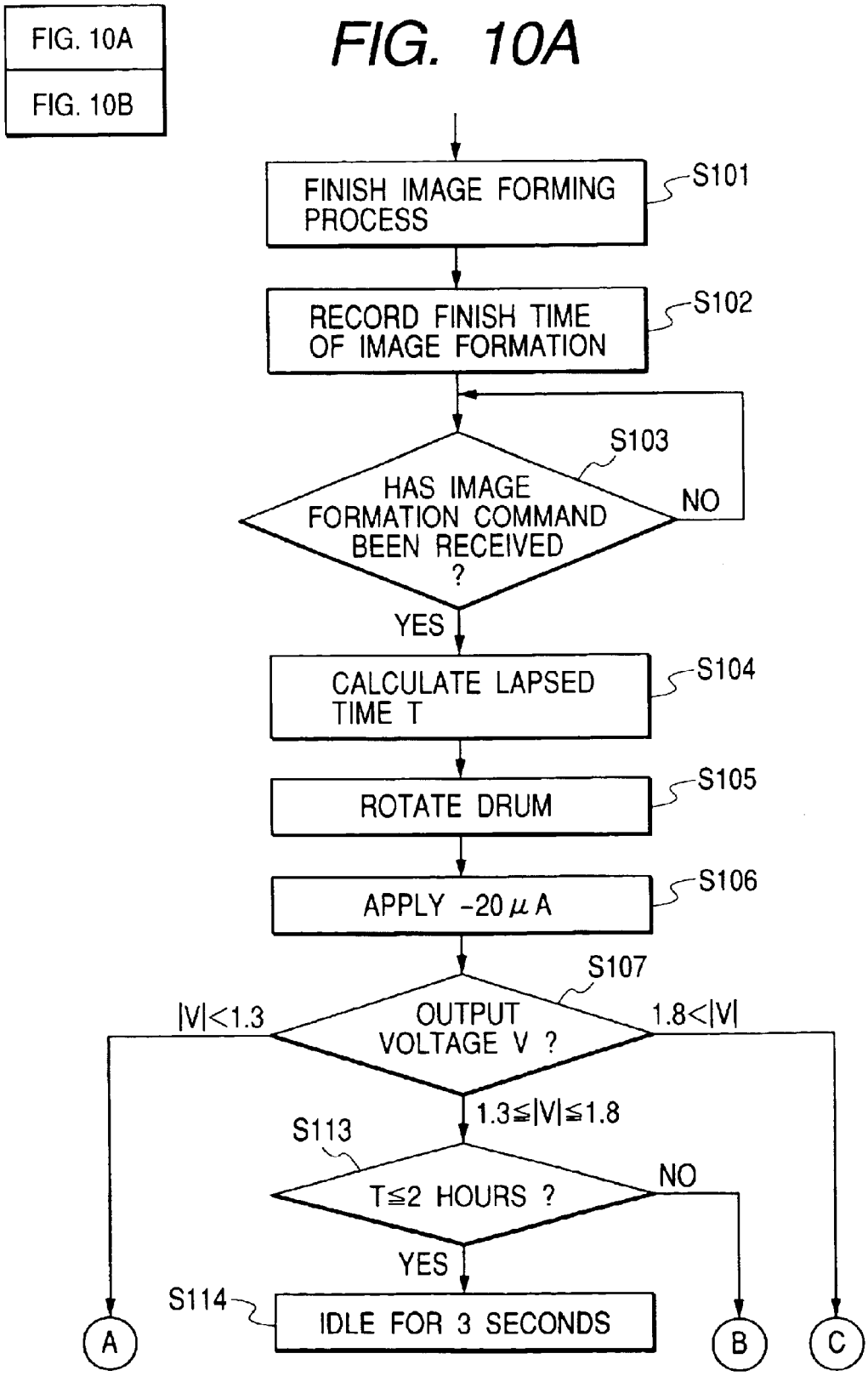
FIG. 10 is comprised of FIGS. 10A and 10B which are flowcharts showing a control method for an image forming apparatus in accordance with a third embodiment of the present invention.
Figure 10B:
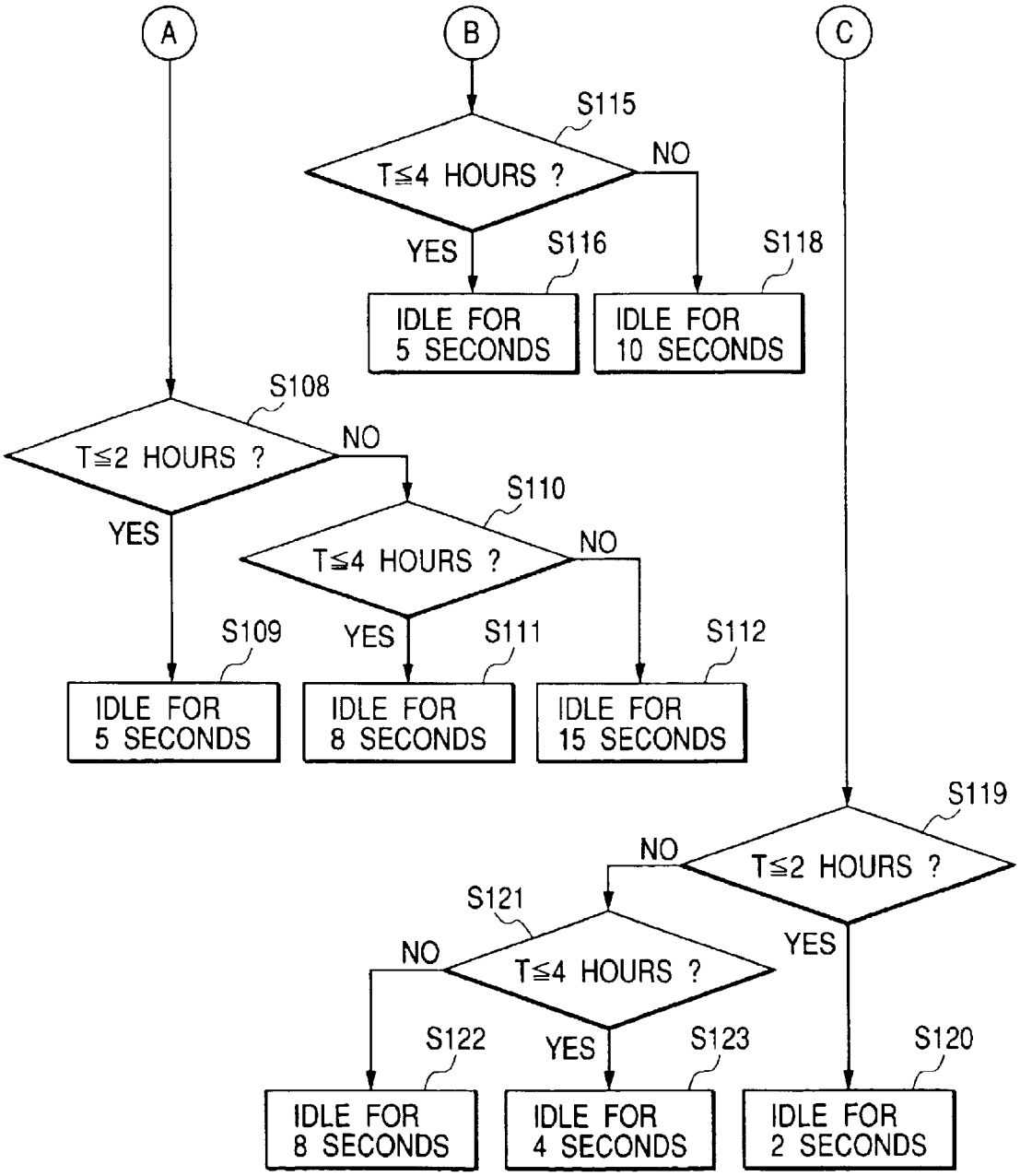

As shown in the flowchart of FIGS. 10A and 10B, this embodiment is characterized in that an appropriate idling time of the developing roller 5 is determined based upon the lapsed time T from finish of an image forming process and the output voltage value V from the charging roller 2.

Judging from the flowchart of FIGS. 10A and 10B, in this embodiment, as described above, in the high temperature and high humidity environment, the idling time of the developing roller 5 is five seconds when T is equal to or shorter than two hours, eight seconds when T is longer than two hours and equal to or shorter than four hours, and fifteen seconds when T is longer than four hours. In addition, in the normal temperature and normal humidity environment in which the output voltage |V| is equal to or larger than 1.3 kV and equal to or smaller than 1.8 kV in step S107, the idling time of the developing roller 5 is three seconds when T is equal to or shorter than two hours, five seconds when T is longer than two hours and equal to or shorter than four hours, and ten seconds when T is longer than four hours. In the low temperature and low humidity environment in which the output voltage |V| is larger than 1.8 kV in step S107, the idling time of the developing roller 5 is two seconds when T is equal to or shorter than two hours, four seconds when T is longer than two hours and equal to or smaller than four hours, and eight seconds when T is longer than four hours.

That is, the control method for the image forming apparatus of the present invention has a step of idling the developing roller for a predetermined period of time in a state in which the photosensitive drum and the developing roller are separated from each other according to lapsed time information calculated by the storage means and the reading/writing means and environmental information detected by the environment detection means.

By controlling an idling time of a developer carrying member with such a control method, even in the case in which image formation is performed after leaving a toner as it is for a long time, it becomes possible to give a sufficient charge to the toner in advance before an image forming process according to an environment of a place where the image forming apparatus is installed. Consequently, it becomes possible to prevent occurrence of an image failure such as a low image density or a non-uniform image density.

In addition, since an idle process of the developing roller is performed in a state in which the developing roller is separated from a surface of a photosensitive drum, it also becomes possible to prevent occurrence of an image failure such as unnecessary transfer of a toner onto the surface of the photosensitive drum or scattering of the toner in the apparatus.

Note that, in this embodiment, as means for automatically detecting an environment of a place where the image forming apparatus is installed, the charging roller provided in the image forming apparatus is used. However, the means is not limited to this.

In addition, it is needless to mention that it is also possible to obtain environmental information by providing well-known detecting means such as a temperature and humidity sensor in a part of the image forming apparatus other than the charging roller.

Moreover, in addition to this embodiment, it is needless to mention that an idling time of the developing roller may be determined by also making the idling time variable according to an amount of toner remaining in the developing device as described in the second embodiment.

In the contact development using a substantially spherical mono-component nonmagnetic toner, even in the case in which image formation is performed after the toner is left as it is for a long time, it becomes possible to prevent occurrence of an image failure such as a low image density or a non-uniform image density.

Fourth Embodiment

Another embodiment of the image forming apparatus and the control method therefor in accordance with the present invention will be hereinafter described. Members identical with those described in the first embodiment will be denoted by identical reference symbols, and a description thereof will be omitted.

In the image forming apparatus adopting the contact development using the mono-component nonmagnetic toner as in the third embodiment, especially when using unused developing means, image failure such as insufficiency of an image density and non-uniformity of an image density due to insufficiency of a toner charging amount as described in the conventional example may occur.

Thus, in the present invention, as shown in FIG. 1, the developing devices 4*a* to 4*d* are provided with the memory portion B serving as storage means such as a flash memory capable of recording and referring to an image formation history in addition to the developing roller 5, the supply roller 6, the developing blade 7, the agitating member 8, and the like, respectively.

In addition, before starting the image formation for one time including the continuous image formation, there is provided a preparation process so-called pre-rotation for heating or the like of a fixing device.

Figure 14:
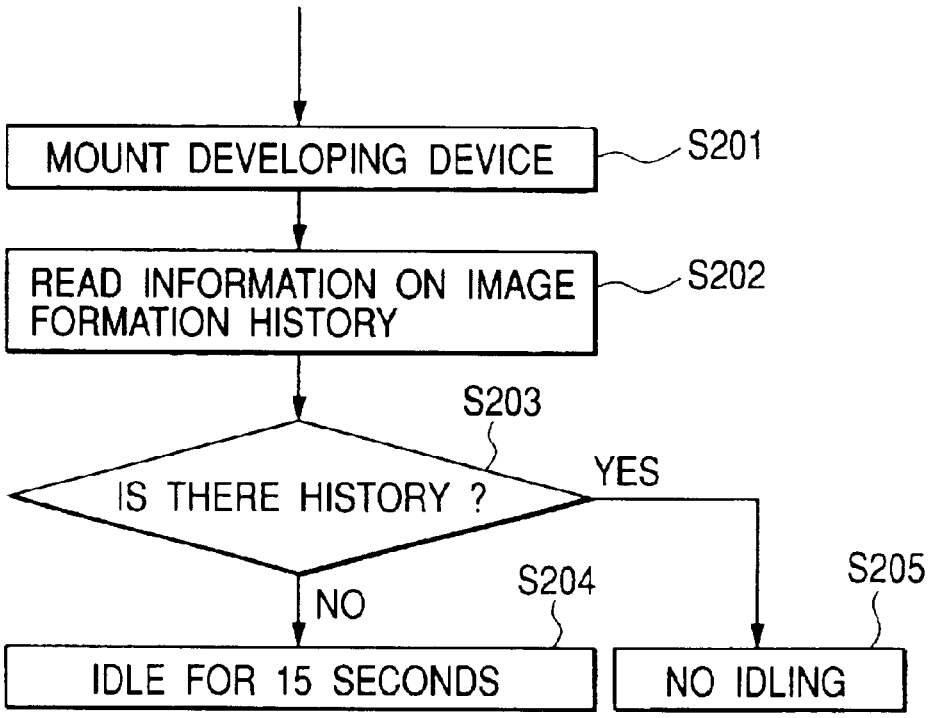
FIG. 14 is a flowchart showing a control method for an image forming apparatus in accordance with the fifth embodiment the present invention.

Then, in the manufactured image forming apparatus, when image formation for one time using this developing means is started, in a preparation process, it is distinguished whether or not the developing means is in an unused state according to existence of an image formation history stored in the storage means in accordance with the control method of the image forming apparatus to be described later with reference to a flowchart of FIG. 14. In the case in which the developing means is unused, a developing roller in the developing means is idled before a developing operation is performed, whereby insufficiency of a charging amount of a toner may be prevented.

Thus, next, communication between the memory portion B provided in the developing device of the image formation apparatus and an image forming apparatus main body relating to the control method for the image forming apparatus of the present invention will be described with reference to FIG. 4, since the communication is similar to that in the third embodiment.

A storage portion F for storing information is provided in the memory portion B. As described above, any element can be applied to this storage portion F as long as the element is a nonvolatile storage element such as a flash memory, an EEPROM, or an FERAM (ferroelectric memory). This memory portion B can be accessed by reading/writing means (read/write control portion) C provided in the image forming apparatus A.

The image forming apparatus A includes a process control portion PD for controlling image formation, and the process control portion PD includes a read/write control portion C for accessing the storage portion F of the memory portion B to read out information or performing writing control. In this embodiment, history information obtained by forming an image in the image forming apparatus A is stored in a predetermined area of the storage portion F.

Figure 13:
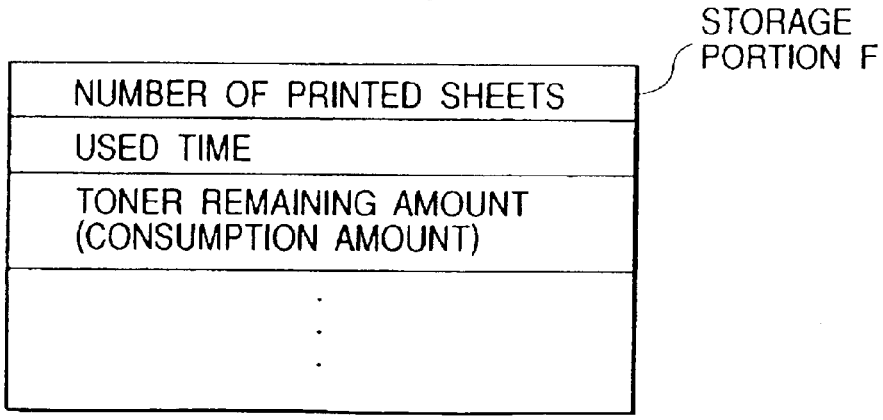
FIG. 13 is an explanatory diagram showing a storage portion of storage means in accordance with a fifth embodiment the present invention.

Note that, as shown in FIG. 13, the history information is information relating to a history of image formation such as information on the number of printed sheets, a remaining amount or a used amount of a developer (toner) in the developing devices 4*a* to 4*d*, and driving time information of the developing roller 5 which are written in the storage portion F.

In addition, instead of the read/write control portion C, the process control portion PD (CPU) for controlling a process of the image forming apparatus A may perform read/write control, or a separate dedicated control portion may be provided to control reading and writing.

Further, the communication between the read/write control portion C and the memory portion B may be performed by connecting signal lines (or bringing signal lines into contact with each other) or may adopt a system for communication with wireless communication such as communication by electromagnetic wave using an antenna or optical communication.

Here, an operation in accordance with the control method for the image forming apparatus in accordance with the present invention, in particular, an operation in accordance with the control method for the image forming apparatus in the preparation process before image formation for one time will be described with reference to a flowchart of FIG. 14. Note that all the four developing devices 4*a* to 4*d* provided in the image forming apparatus A have the same structure except colors of toners contained therein, and a developing device 4' described below indicates any one of the four developing devices 4*a* to 4*d*.

Further, it is assumed that the image formation for one time means, as described above, an operation for performing an image forming process on one transfer material P or an operation for repeatedly applying the image forming process to plural transfer materials P. Then, a time before the image formation for one time when the preparation process is performed means a time slot from a time when the developing device 4' is mounted until a time when an electrostatic latent image is formed on the photosensitive drum 1 and the developing device 4' operates.

First, in step S201, the developing device 4' serving as a development cartridge E is mounted on the image forming apparatus A. In a state in which a developing device mounting cover D of the image forming apparatus A is closed, in step S202, information on image formation history recorded in the storage portions F of the memory portions B of the respective developing devices is sequentially read by the read/write control portion C of the image forming apparatus A.

Then, when it is identified in step S203, which is a judgment step, that no information on image formation history is stored in the storage portion F of the memory portion B of the developing device 4' (e.g., when read-out data indicates an initial value stored in advance in a state in which the cartridge is unused), that is, the developing device 4' is an unused developing device, the process control portion PD of the image forming apparatus main body recognizes that it is a developing device in an unused state. In step S204, the developing device 4' rotates in the direction of arrow in FIG. 1 to move to the development position opposed to the photosensitive drum 1, and the developing roller 5 is driven to rotate for fifteen seconds by the motor (not shown) in a state in which the developing roller 5 is separated from the surface of the photosensitive drum 1 by the contact/separation mechanism 40. If an image formation history exists in the developing device 4' in step S203, which is a judgment step, the processing proceeds to step S205, and idling of the developing roller 5 is not performed.

In the case in which there are plural developing devices 4' in an unused state, the same operation is applied to all the developing devices.

Then, when the series of operations are finished, the developing apparatus 4 rotates to a predetermined home position and stops, and the above-mentioned image formation is started.

That is, the control method for the image forming apparatus of the present invention includes a step of reading history information of storage means with a read/write control portion before image formation using developing means in a developing operation, a step of judging whether or not the developing means is in an unused state according to existence of the history information, and a step of, if it is judged in the judgment step that the developing means is in an unused state, separating a developing roller from a photosensitive drum to perform idling for a predetermined period of time.

On the other hand, in this embodiment, idling of a developing roller in a preparation process is not performed for a developing device having an image formation history. However, control may be performed for such a developing device as well such that idling is performed designating the number of rotations or the like of the developing roller.

Even in the case in which the developing device being in an unused state is used for the first time to perform image formation in this way, a toner can be coated uniformly on a surface of the developing roller before an image forming process. In addition, it becomes possible to give a sufficient charge to the toner in advance, and it becomes possible to prevent occurrence of an image failure such as a low image density or a non-uniform image density.

In addition, since an idle process of the developing roller is performed in a state in which the developing roller is separated from a surface of a photosensitive drum, it also becomes possible to prevent occurrence of an image failure such as unnecessary transfer of a toner onto the surface of the photosensitive drum or scattering of the toner in the apparatus.

Fifth Embodiment

Another embodiment of the image forming apparatus and the control method therefor in accordance with the present invention will be hereinafter described. Members identical with those described in the first embodiment and the fourth embodiment will be denoted by identical reference symbols, and a description thereof will be omitted.

The control method for the image forming apparatus of this embodiment is characterized in that a time for idling of the developing roller 5, which is performed in the preparation process before image formation at the time when the developing device 4' in an unused state is mounted on the image forming apparatus, is varied according to a color of a toner contained in the developing device 4'.

It is an object of this embodiment to set an idling time of a developing roller in an image formation preparation process, which is optimal for respective toners, with respect to a difference of chargeability of respective color toners.

That is, chargeability of the toner contained in the developing device 4' may be different according to a difference of materials such as binding resin and colorants forming the respective color toners, a difference of a type or an amount, or liquidity associated with this, of extraneous additives as supplementary agents to be added in accordance with characteristics of the respective color toners. It is an object of this embodiment to set chargeability of the respective color toners uniformly to a proper magnitude so as to obtain a high image quality by adjusting an idling time of the developing roller 5 in the preparation process before image formation.

Here, chargeability of the respective color toners will be described. The respective color toners have different formula of extraneous additives, and types and amounts of extraneous additives to be used for the respective toners Y, M, C, and K are different. The extraneous additives have different charging properties according to types, and plural kinds of extraneous additives are selected and formulated in an appropriate amount in accordance with characteristics of materials of the respective color toners. That is, since a type of an extraneous additive to be used (having a different charging property) and an amount for each type of the extraneous additive are different for each color toner, chargeability of the respective color toners is different.

In this embodiment, control for adjusting an idling time of a developing roller is performed according to this difference of chargeability.

Figure 15:
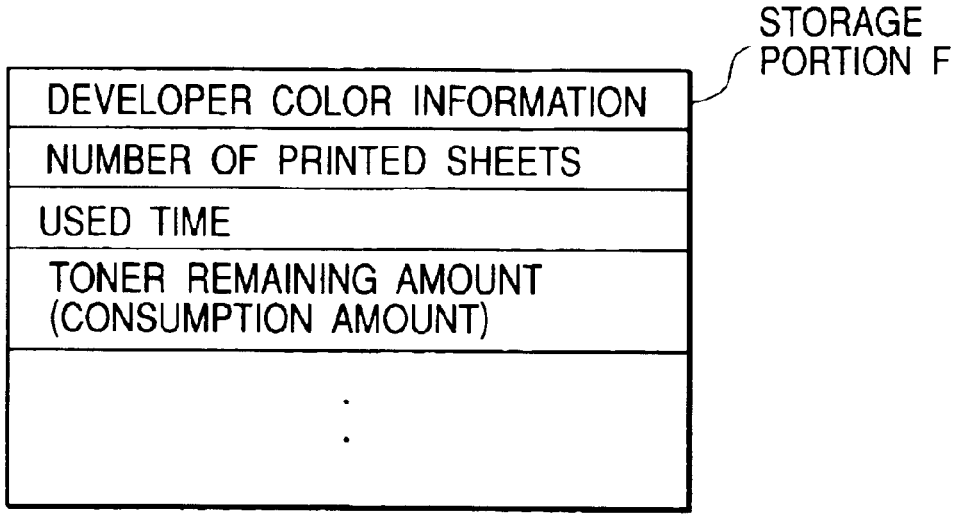
FIG. 15 is an explanatory diagram showing a storage portion of storage means in accordance with a sixth embodiment of the present invention.

FIG. 15 shows that information on a contained developer color (contained toner color) and history information are stored in the storage portion F of the memory portion B. This embodiment is characterized in that an idling time of the developing roller 5 optimal for the respective toners is set using the information on a contained developer color and the history information.

Figure 16:
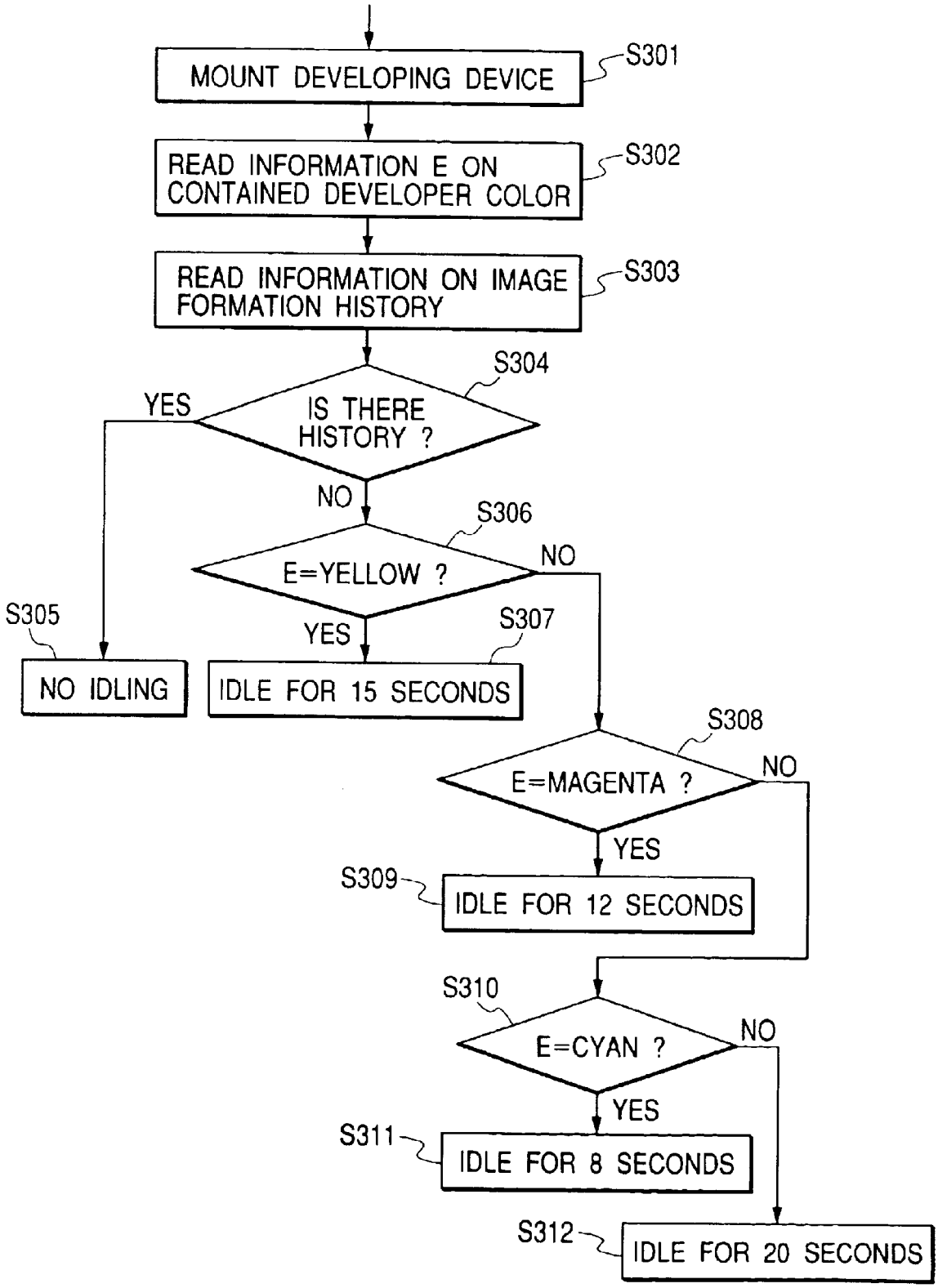
FIG. 16 is a flowchart showing a control method for an image forming apparatus in accordance with the sixth embodiment of the present invention.

Here, an operation in accordance with the control method for the image forming apparatus in accordance with the present invention, in particular, an operation in accordance with the control method in the preparation process before image formation will be described with reference to FIG. 16.

First, in step S301, the developing device 4' is mounted on the image forming apparatus A and, in a state in which the developing device mounting cover D of the image forming apparatus A is closed, in step S302, the information on a contained developer color recorded in the storage portion F of the memory portion B of each developing device is read by the read/write control portion C of the image forming apparatus A. Then, in step S303, the information on image formation history is read by the read/write control section C.

Then, when the developing device 4' not having information on image formation history does not exist in step S304 which is a judgment step, since all the developing devices 4*a* to 4*d* in this image forming apparatus were used in the past, the processing proceeds to step S305, and the developing rollers 5 are not required to idle. If the developing device 4' not having information on image formation history exists in step S304 which is a judgment step, it is recognized that this device is the developing device 4' in an unused state, and the processing proceeds to step S306. The developing apparatus 4 rotates in the direction of arrow in FIG. 1, and the developing device 4' moves to the development position opposed to the photosensitive drum 1.

Then, in step S306, it is judged whether or not the selected developing device 4' is the yellow developing device 4*a* in the read/write control portion C. If the developing device 4' is the yellow developing device 4*a*, the processing proceeds to step S307. The developing roller 5 is idled for fifteen seconds by the motor (not shown) in a state in which the developing roller 5 is separated from the surface of the photosensitive drum 1 by the contact/separation mechanism 40. If it is judged in step S306 that the developing device 4' is not the yellow developing device 4*a*, the processing proceeds to step S308, where it is judged whether the developing device 4' is the magenta developing device 4*b*. If the developing device 4' is the magenta developing device 4*b*, the processing proceeds to step S309, where the developing roller 5 is idled for twelve seconds in the same manner. If it is judged in step S308 that the developing device 4' is not the magenta developing device 4*b* either, the processing proceeds to step S310, where it is judged whether or not the developing device 4' is the cyan developing device 4*c*. If the developing device 4' is the cyan developing device 4*c*, the processing proceeds to step S311, where the developing roller 5 is idled for eight seconds. If it is judged in step S310 that the developing device 4' is not the cyan developing device 4*c*, it is judged that the selected developing device 4' is the black developing device 4*d*, and the processing proceeds to step S312, where the developing roller 5 idles for twenty seconds.

In this way, the developing roller 5 is driven to rotate for a predetermined period of time set in advance for each color.

In the case in which plural developing devices 4' are in an unused state, the same operation is applied to all the developing devices 4'.

Then, when the series of operations are finished, the developing apparatus 4 rotates to a predetermined home position and stops, and the above-mentioned image formation is started.

That is, the control method for the image forming apparatus according to this embodiment includes: a step of reading information on a contained developer color recorded in storage means with a read/write control portion if it is judged in a judgment step that a developing device is unused; and a step of idling a developing roller for a predetermined period of time according to the information on a contained developer color.

On the other hand, in this embodiment, idling of a developing roller in a preparation process is not performed for a developing device having an image formation history. However, control may be performed for such a developing device as well so as to perform idling while designating the number of rotations or the like of the developing roller according to color information stored in the storage means provided in the developing device.

Consequently, even in the case in which the developing device being in an unused state is used for the first time to perform image formation, a toner can be coated uniformly on a surface of the developing roller before image formation. In addition, an appropriate idling time of the developing roller in a preparation process can be controlled according to a color of a toner, it becomes possible to give a sufficient charge to the toner in advance, and it becomes possible to prevent occurrence of an image failure such as a low image density or a non-uniform image density.

In addition, since the idling process of the developing roller is performed in a state in which the developing roller is separated from the surface of the photosensitive drum, it also becomes possible to prevent occurrence of an image failure such as unnecessary transfer of a toner onto the surface of the photosensitive drum or scattering of the toner in the apparatus.

Note that the idling time of the developing roller for each color toner described in this embodiment is only an example and is not limited to this.

Sixth Embodiment

Another embodiment of the image forming apparatus and the control method therefor in accordance with the present invention will be hereinafter described. Members identical with those described in the first and fourth embodiments will be denoted by identical reference symbols, and a description thereof will be omitted.

As to the image forming apparatus of this embodiment, in the control method, there are provided a step of automatically detecting an environment around a place where the image forming apparatus is installed and a step of varying a time for idling of the developing roller 5, which is performed in the preparation process before image formation when a developing device of an unused state is mounted on the image formation apparatus, according to this environmental information.

It is an object of this embodiment to perform control such that excessive stress is not exerted on the toner due to an environmental state around a place where the image forming apparatus is installed. A charge imparting property to a toner varies depending upon the environmental state around a place where the image forming apparatus is installed. In the case in which it is relatively difficult to give a charge uniformly as under a high temperature and high humidity environment, a sufficient amount of charge is given by setting the idling time of the developing rollers long. In addition, in the case in which it is relatively easy to give a charge uniformly as under a low temperature and low humidity environment, the idling time of the developing rollers is set short.

First, this environment detection means will be described. In the image forming apparatus in this embodiment, the charging roller 2 as shown in FIG. 1 is provided as charging means. In general, a material forming the charging roller 2 has a characteristic that a resistance value thereof changes according to ambient environmental conditions. Under a low temperature and low humidity environment, the resistance value of the charging roller 2 tends to increase compared with that under a normal temperature normal humidity environment. On the contrary, under a high temperature and high humidity environment, the resistance value of the charging roller 2 tends to decrease compared with that under the normal temperature and normal humidity environment. Thus, by detecting the resistance value of the charging roller 2, it becomes possible to recognize an environmental state around a place where the image forming apparatus is installed, which is effective as environment detection means.

Here, FIG. 9 shows an experimental result concerning environmental dependency of a voltage, which is generated when a DC bias controlled to a constant current of −20 $\mu$A is applied to the charging roller 2, at the time when the image forming apparatus in accordance with this embodiment is used and the charging roller 2 abuts against a non-image forming area of the rotating photosensitive drum 1. The environmental dependency is similar to that of the third embodiment.

According to this experimental result, a generated voltage under the normal temperature and normal humidity environment is −1.7 kV, whereas, since the resistance value of the charging roller 2 is relatively high under the low temperature and low humidity environment, a voltage generated at this point is as high as −2.0 kV. On the contrary, under the high temperature and high humidity environment, since the resistance value of the charging roller 2 is relatively low, a voltage generated at this point is as low as −1.2 kV.

Thus, by detecting whether the generated voltage is higher or lower than a value set in advance while taking into account fluctuation of the resistance value of the charging roller 2, it becomes possible to distinguish an environmental state around a place where the image forming apparatus is installed.

Therefore, in this embodiment, a lower limit value of an output voltage for judging that the ambient environmental state is the low temperature and low humidity environment is set to −1.8 kV, and an upper limit value of an output voltage for judging that the ambient environmental state is the high temperature and high humidity environment is set to −1.3 kV.

Figure 17:
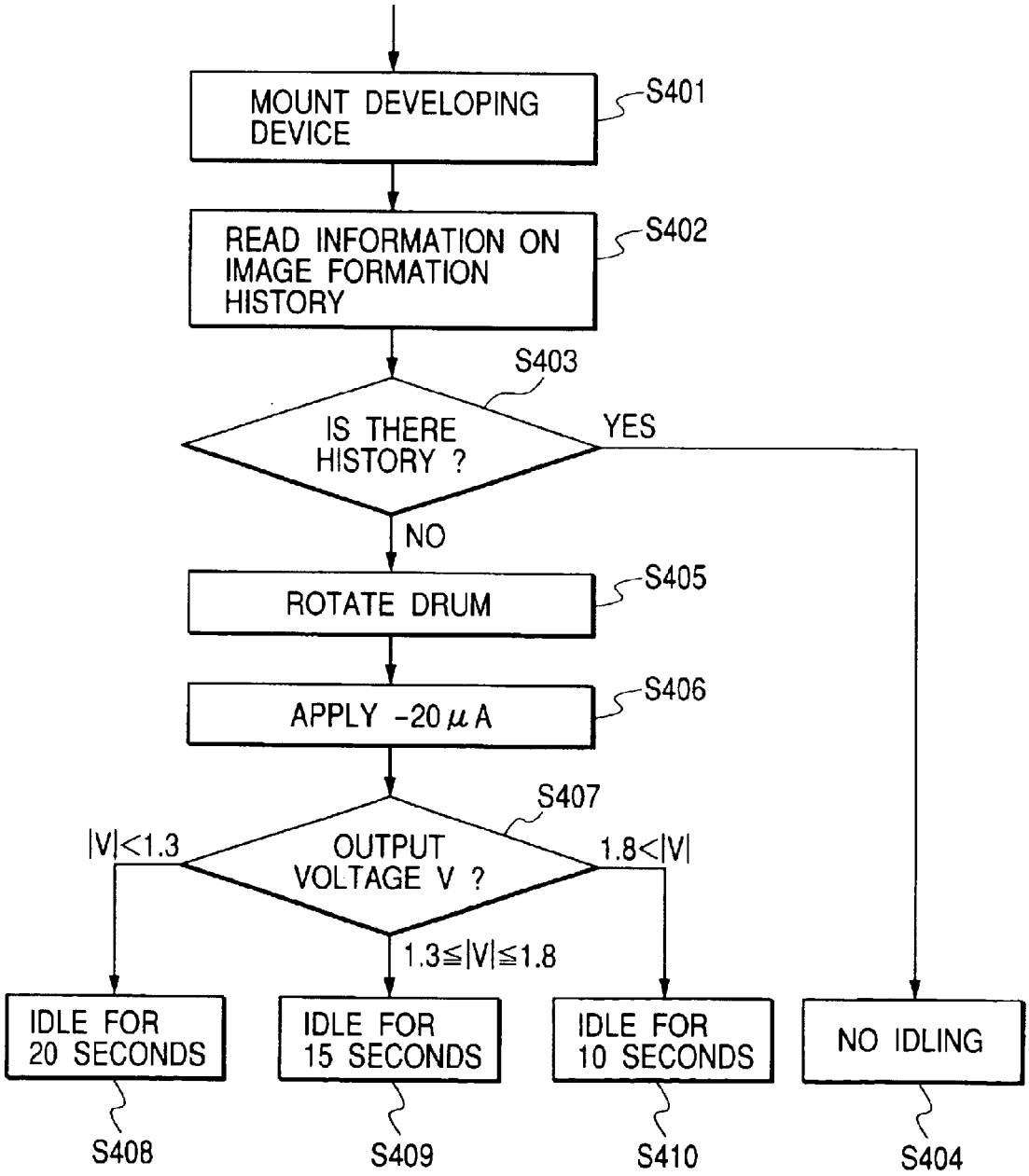
FIG. 17 is a flowchart showing a control method for an image forming apparatus in accordance with a seventh embodiment of the present invention.

Here, an operation in accordance with the control method for the image forming apparatus in accordance with the present invention, in particular, an operation in accordance with the control method in the preparation process before image formation will be described with reference to FIG. 17.

First, in step S401, the developing device 4' is mounted on the image forming apparatus A. In a state in which the developing device mounting cover D of the image forming apparatus A is closed, in step S402, information on image formation history recorded in the storage portions F of the memory portions B of the respective developing devices is sequentially read by the read/write control portion C of the image forming apparatus A.

Note that the developing rollers 5 are separated from the photosensitive drum 1 by the contact/separation mechanisms 40 of the developing devices 4*a* to 4*d* at this point.

If there is information on image information history, the developing roller 5 is caused to idle in step 404.

Then, the developing device 4' not having information on image formation history exists in step S403 which is a judgment step, it is recognized that the device is a developing device in an unused state. When the charging roller 2 abuts against the non-image forming area of the rotating photosensitive drum 1 in step S405, a DC bias controlled to a constant current of −20 μA is applied to the charging roller 2 in step S406.

Then, for example, when an output voltage |V| at this point is judged smaller than 1.3 kV in step S407, that is, it is detected that the ambient environmental state is the high temperature and high humidity environment, the developing apparatus 4 mounted with the developing device 4' rotates in the direction of arrow, and the developing device 4' moves to the development position opposed to the photosensitive drum 1. In step S408, the developing roller 5 is driven to idle for twenty seconds by the motor (not shown) in a state in which the developing roller 5 is separated from the surface of the photosensitive drum 1.

In addition, when the output voltage |V| is larger than 1.8 kV in step S407, the ambient environmental state is the low temperature and low humidity environment, and the processing proceeds to step S410, and the developing roller 5 idles for ten seconds. When the output voltage |V| is equal to or larger than 1.3 kV and equal to or smaller than 1.8 kV and the ambient environmental state is judged as the normal temperature and normal humidity environment, the processing proceeds to step S409, and the developing roller 5 idles for fifteen seconds.

In the case in which plural developing devices 4' are in an unused state, the same operation is applied to all the developing devices 4'.

Then, when the series of operations are finished, the developing apparatus 4 rotates to a predetermined home position and stops, and the above-mentioned image formation is started.

On the other hand, in this embodiment, idling of a developing roller in a preparation process is not performed for a developing device having an image formation history. However, control may be performed for such a developing device as well so as to perform idling while designating the number of rotations or the like of the developing roller.

In this way, a time during which the developing roller should be idled in the unused developing device 4' before image formation is determined according to ambient environmental information obtained by using the charging roller 2 provided in the image forming apparatus.

Consequently, even in the case in which the developing device being in an unused state is used for the first time to perform image formation, a toner can be coated uniformly on a surface of the developing roller before an image forming process. In addition, it becomes possible to give a sufficient charge to the toner in advance, and it becomes possible to prevent occurrence of an image failure such as a low image density or a non-uniform image density.

In addition, since the idling process of the developing roller is performed in a state in which the developing roller is separated from the surface of the photosensitive drum, it also becomes possible to prevent occurrence of an image failure such as unnecessary transfer of a toner onto the surface of the photosensitive drum or scattering of the toner in the apparatus.

Note that, in this embodiment, as means automatically detecting an environment around a place where the image forming apparatus is installed, the charging roller provided in the image forming apparatus is used. However the means is not limited to this.

In addition, it is needless to mention that it is also possible to obtain environmental information by providing well-known detecting means such as a temperature and humidity sensor in a part of the image forming apparatus.

Moreover, in addition to this embodiment, as described in the fifth embodiment, it is needless to mention that an idling time of the developing roller may be determined by also making the idling time variable according to a color of a toner contained in a developing device.

In the contact development using a substantially spherical mono-component nonmagnetic toner, even in the case in which image formation is performed using developing means in an unused state for the first time, it becomes possible to prevent occurrence of an image failure such as a low image density or a non-uniform image density.

Seventh Embodiment

Figure 11:
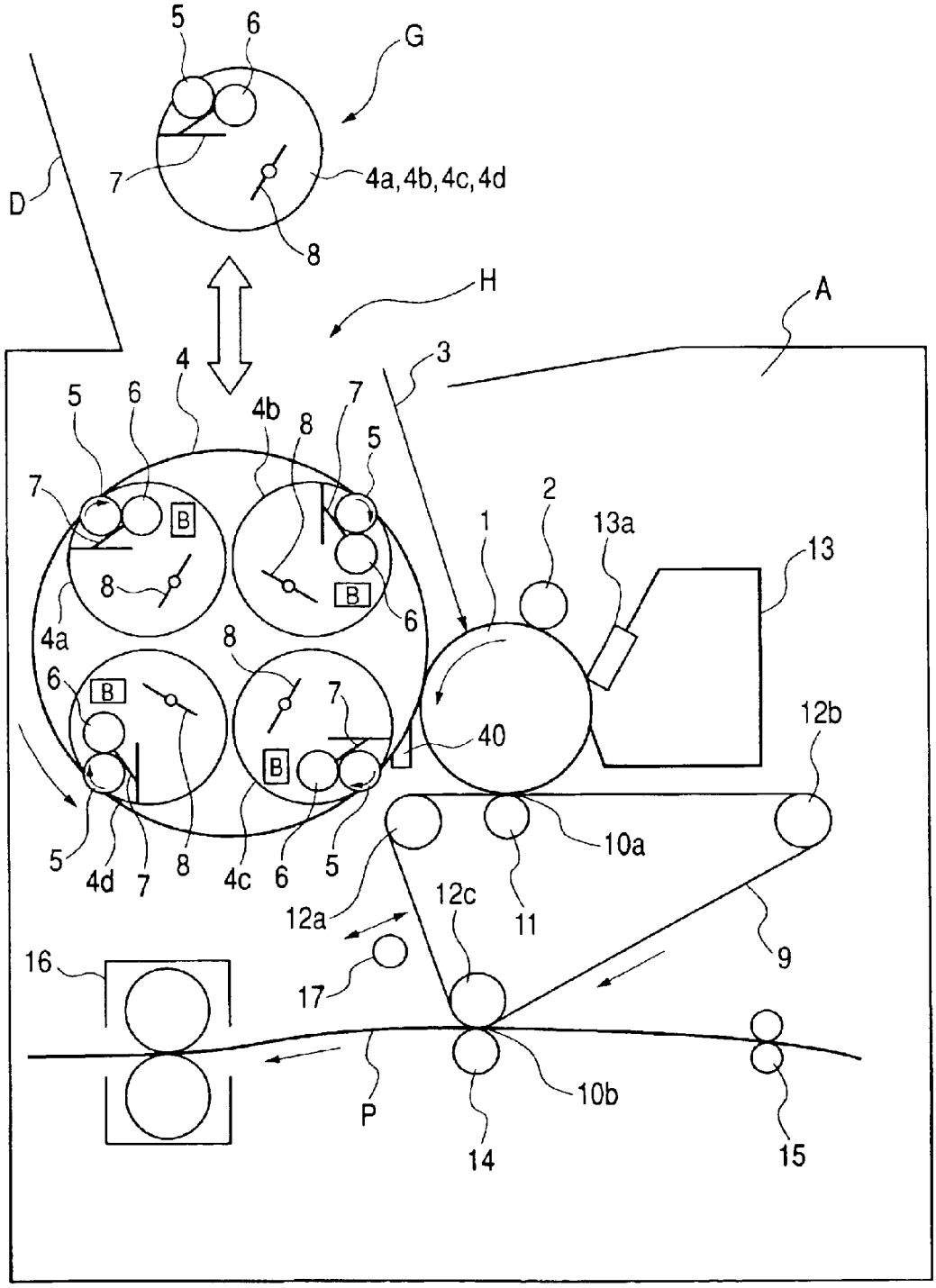
FIG. 11 is a schematic diagram showing another example of the image forming apparatus in accordance with the present invention.
Figure 12:
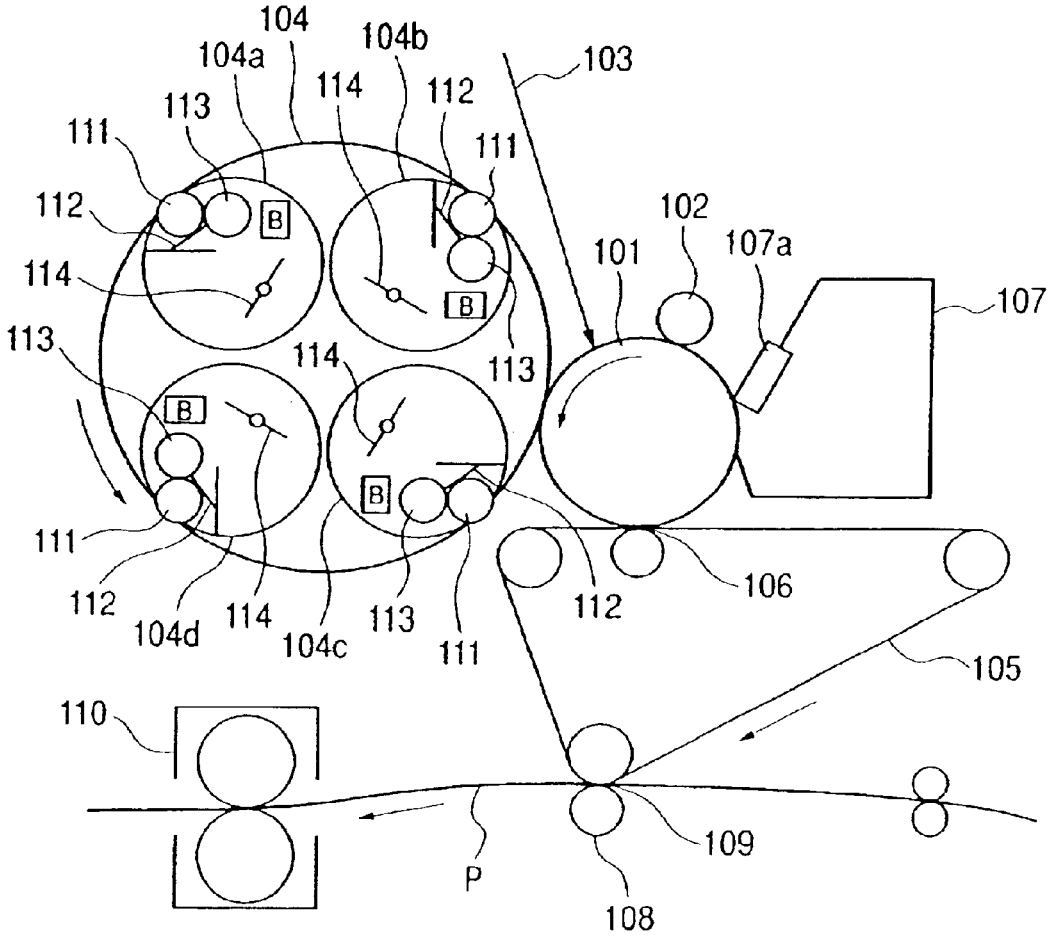
FIG. 12 PRIOR ART
FIG. 12 is a schematic diagram showing an example of a conventional image forming apparatus.

In this embodiment, as shown in FIG. 11, in the image forming apparatus A of the same structure as the first to third embodiments, each of the developing devices 4*a* to 4*d* mounted on the developing apparatus 4 is a development cartridge G which is detachably attachable to the image forming apparatus A through a loading and unloading port H.

The development devices 4*a* to 4*d* contain a predetermined toner, respectively, and are provided with at least the developing roller 5 and the memory portion B.

Since the developing devices 4*a* to 4*d* are constituted as cartridges and are made detachably attachable, maintainability for replacement of a toner or the like is improved.

It is needless to mention that the effects as described in the first to sixth embodiments can also be attained here.

Note that, in the first to seventh embodiments, the structure of the image forming apparatus is not limited to that shown in FIG. 1 but may be an inline system having plural photosensitive drums 1 or a structure for directly transferring an image from a photosensitive drum to a transfer member without using an intermediate transfer member.

As described above, according to the above-mentioned embodiments of the present invention, even in the case in which image formation is performed after a toner is left as it is for a long time, it becomes possible to prevent occurrence of image failure such as a low image density or a non-uniform image density.

In addition, according to the above-mentioned embodiments of the present invention, even in the case in which developing means being in an unused state is used for the first time to perform image formation, it becomes possible to prevent occurrence of image failure such as a low image density or a non-uniform image density.

Further, according to the above-mentioned embodiments of the present invention, since a developer carrying member is driven to idle for a predetermined period of time according to remaining developer amount information and environmental information detected by environment detection means, it becomes possible to prevent occurrence of image failure such as a low image density or a non-uniform image density regardless of an amount of developer in developing means or an ambient environment.

The present invention is not limited to the above-mentioned embodiments but can include modifications of the identical technical thought.

What is claimed is:

1. An image forming apparatus comprising:

an image bearing member on a surface of which an electrostatic latent image is formed;

developing means, which contains a developer, and which includes a rotatable developer carrying member, which abuts against the surface of the image bearing member, and storage means storing information on image formation history, wherein the developing means is adapted to visualize the electrostatic latent image formed on the surface of the image bearing member as the developer carrying member carries the developer to the electrostatic latent image;

a contact/separation mechanism, which enables the developer carrying member to abut against and separate from the surface of the image bearing member;

control means, which in a preparation process before image formation of second and subsequent times using the developing means, finds a lapsed time from a finish time of a last image formation until a start time of a current image formation based upon the information on image formation history stored in the storage means and, in a state in which the image bearing member and the developer carrying member are separated from each other by the contact/separation mechanism, and operates the developer carrying member for a predetermined period of time according to the lapsed time; and developer remaining amount detection means, which detects an amount of developer remaining in the developing means, wherein, in the preparation process before image formation of the second and subsequent times using the developing means, in a state in which the image bearing member and the developer carrying member are separated from each other, the control means operates the developer carrying member for the predetermined period of time according to the lapsed time and information on the developer remaining amount detected by the developer remaining amount detection means.

2. An image forming apparatus according to claim 1, further comprising environment detection means, which detects an environmental state of an apparatus main body, wherein, in the preparation process before image formation of the second and subsequent times using the developing means, in the state in which the image bearing member and the developer carrying member are separated from each other, the control means operates the developer carrying member for the predetermined period of time according to the lapsed time and information on the environmental state detected by the environment detection means.

3. An image forming apparatus according to claim 1, wherein the operation of the developer carrying member for the predetermined period of time is an operation for giving a charge to the developer.

4. An image forming apparatus according to claim 1, wherein the preparation process before image formation is a preparation process before the developer carrying member carries the developer to the electrostatic latent image.

5. An image forming apparatus according to claim 1, wherein the developer is a mono-component nonmagnetic toner.

6. An image forming apparatus according to claim 1, wherein the developer has a shape factor SF1 of 100 to 160 and a shape factor SF2 of 100 to 140.

7. An image forming apparatus according to claim 1, wherein the developing means is a development cartridge, which is detachably attachable to the image forming apparatus.

8. A control method for an image forming apparatus for controlling an image forming operation in an image forming apparatus including: an image bearing member; developing means, which contains a developer, and which includes a rotatable developer carrying member, which abuts against the image bearing member, and storage means storing information on image formation history, wherein the developing means is adapted to form an image formed on the image bearing member as the developer carrying member carries the developer to the image bearing member; a contact/separation mechanism, which enables the developer carrying member to abut against and separate from the surface of the image bearing member; and reading/writing means, which accesses the storage means; and developer remaining amount detection means, which detects an amount of developer remaining in the developing means, the control method comprising the steps of:

reading the information on image formation history stored in the storage means with the reading/writing means before image formation of a second and subsequent times using the developing means;

finding a lapsed time from a finish time of a last image formation until a start time of a current image formation based upon the information on image formation history;

operating, in a state in which the image bearing member and the developer carrying member are separated from each other by the contact/separation mechanism, the developer carrying member for a predetermined period of time according to the lapsed time, and operating, in a state in which the image bearing member and the developer carrying member are separated from each other, the developer carrying member for the predetermined period of time according to the lapsed time and information on the developer remaining amount detected by the developer remaining amount detection means.

9. A control method for an image forming apparatus according to claim 8, wherein the image forming apparatus further includes environment detection means, which detects an environmental state of an apparatus main body, the control method further comprising the steps of:

operating, in the state in which the image bearing member and the developer carrying member are separated from each other, the developer carrying member for the predetermined period of time according to the lapsed time and information on the environmental state detected by the environment detection means.

10. A control method for an image forming apparatus according to claim 8, wherein the operation of the developer carrying member for the predetermined period of time is an operation for giving a charge to the developer.

11. An image forming apparatus comprising:

an image bearing member on a surface of which an electrostatic latent image is formed;

developing means, which contains a developer, and which includes a rotatable developer carrying member, which abuts against the surface of the image bearing member, and storage means storing information on image formation history and color information of the developer contained in the developing means, wherein the developing means is adapted to visualize the electrostatic latent image formed on the surface of the image bearing member as the developer carrying member carries the developer to the electrostatic latent image;

a contact/separation mechanism, which enables the developer carrying member to abut against and separate from the surface of the image bearing member; and control means which, in a preparation process before image formation using the developing means, judges whether the developing means is in an unused state based upon existence of information on image formation history stored in the storage means and, in a case in which the developing means is recognized as being in the unused state, and operates the developer carrying member for a predetermined period of time in a state in which the developer carrying member is separated from the surface of the image bearing member, wherein in a preparation process before image formation using the developing means, in the case in which the developing means is recognized as being in the unused state, the control means controls an operation time of the developer carrying member according to the color information of the contained developer stored in the storage means.

12. An image forming apparatus according to claim 11, further comprising environment detection means which detects an environmental state of an apparatus main body, wherein, in the preparation process before image formation using the developing means, in the case in which the developing means is recognized as being in the unused state, the control means controls an operation time of the developer carrying member according to the information on the environmental state detected by the environment detection means.

13. An image forming apparatus according to claim 11, wherein the preparation process before image formation is a preparation process before the developer carrying member carries the developer to the electrostatic latent image.

14. An image forming apparatus according to claim 11, wherein a preparation process before image formation is a preparation process before the developer carrying member carries the developer to the electrostatic latent image.

15. An image forming apparatus according to claim 11, wherein the developer is a mono-component nonmagnetic toner.

16. An image forming apparatus according to claim 11, wherein the developer has a shape factor SF1 of 100 to 160 and a shape factor SF2 of 100 to 140.

17. An image forming apparatus according to claim 11, wherein the developing means is a development cartridge, which is detachably attachable to the image forming apparatus.

18. A control method for an image forming apparatus including: an image bearing member; developing means, which contains a developer, and which includes a rotatable developer carrying member, which abuts against the image bearing member; and storage means storing information on image formation history and color information of the developer contained in the developing means, wherein the developing means is adapted to form an image on the image bearing member as the developer carrying member carries the developer to the image bearing member; a contact/separation mechanism, which enables the developer carrying member to abut against and separate from the surface of the image bearing member; and reading/writing means, which accesses the storage means, the control method comprising the steps of:

reading the information on image formation history stored in the storage means with the reading/writing means before image formation using the developing means;

judging whether or not the developing means is in an unused state according to a presence or absence of the information on image formation history;

operating, in a case in which the developing means is judged to be in the unused state, the developer carrying member for a predetermined period of time in a state in which the developer carrying member is separated from the image bearing member, reading, in the case in which the developing means is judged to be in the unused state, the color information of the contained developer recorded in the storage means with the reading/writing means; and operating the developer carrying member for the predetermined period of time according to the color information of the contained developer.

19. A control method for an image forming apparatus according to claim 18, wherein the image forming apparatus further includes environment detection means, which detects an environmental state of an apparatus main body, the control method further comprising the steps of:

operating, in the case in which the developing means is judged to be in the unused state, the developer carrying member for the predetermined period of time according to information on the environmental state obtained by the environment detection means.

20. A control method for an image forming apparatus according to claim 18, wherein the operation of the developer carrying member for the predetermined period of time is an operation for giving a charge to the developer.

21. An image forming apparatus comprising:

an image bearing member on a surface of which an electrostatic latent image is formed;

developing means, which contains a developer, and which includes: a rotatable developer carrying member, which abuts against the surface of the image bearing member, said developing means being adapted, in a state in which the developer carrying member is brought into contact with the image bearing member, to carry the developer from the developer carrying member to the electrostatic latent image to thereby visualize the electrostatic latent image formed on the surface of the image bearing member;

a contact/separation mechanism, which enables the developer carrying member to abut against and separate from the surface of the image bearing member; and control means, which in a state in which the developer carrying member is separated from the surface of the image bearing member, operates the developer carrying member for a predetermined period of time based upon a state of the developing means, wherein, in a case in which the developing means is in an unused state, the control means operates the developer carrying member for the predetermined period of time in a state in which the developer carrying member is separated from the surface of the image bearing member based upon color information of the developer.

22. An image forming apparatus according to claim 21, wherein, in the case in which the developing means is in an unused state, the control means operates the developer carrying member for the predetermined period of time in the state in which the developer carrying member is separated from the surface of the image bearing member.

23. An image forming apparatus according to claim 21, wherein, in the case in which the developing means is in an unused state, the control means operates the developer carrying member for the predetermined period of time in the state in which the developer carrying member is separated from the surface of the image bearing member based upon environmental information of an apparatus main body.

24. An image forming apparatus according to claim 21, wherein the operation of the developer carrying member for the predetermined period of time is an operation for giving a charge to the developer.

25. An image forming apparatus comprising:

an image bearing member on a surface of which an electrostatic latent image is formed;

developing means, which contains a developer, and which includes a rotatable developer carrying member, which abuts against the surface of the image bearing member, the developing means being adapted to visualize the electrostatic latent image on the surface of the image bearing member as the developer carrying member carries the developer to the electrostatic latent image;

a contact/separation mechanism, which enables the developer carrying member to abut against and separate from the surface of the image bearing member; and control means, which operates the developer carrying member according to a lapsed time from a finish time of image formation of the last time until a start time of image formation of this time, wherein, in a state in which the developer carrying member is separated from the surface of the image bearing member, the control means operates the developer carrying member for a predetermined period of time based upon the lapsed time and information on a remaining amount of the developer in the developing means.

26. An image forming apparatus according to claim 25, wherein, in a state in which the developer carrying member is separated from the surface of the image bearing member, the control means operates the developer carrying member for a predetermined period of time based upon the lapsed time and environmental information of an apparatus main body.

27. An image forming apparatus according to claim 25, wherein the operation of the developer carrying member for the predetermined period of time is an operation for giving a charge to the developer.

* * * * *